US008656712B2

(12) United States Patent
Howes et al.

(10) Patent No.: US 8,656,712 B2
(45) Date of Patent: Feb. 25, 2014

(54) ENERGY STORAGE

(75) Inventors: Jonathan Sebastian Howes, Cambridge (GB); James Macnaghten, Cambridge (GB)

(73) Assignee: Isentropic Limited, Cambridge (GB)

( * ) Notice: Subject to any disclaimer, the term of this patent is extended or adjusted under 35 U.S.C. 154(b) by 333 days.

(21) Appl. No.: 12/681,586

(22) PCT Filed: Oct. 3, 2008

(86) PCT No.: PCT/GB2008/003336

§ 371 (c)(1),
(2), (4) Date: Jun. 17, 2010

(87) PCT Pub. No.: WO2009/044139

PCT Pub. Date: Apr. 9, 2009

(65) Prior Publication Data

US 2010/0257862 A1 Oct. 14, 2010

(30) Foreign Application Priority Data

Oct. 3, 2007 (GB) ..... 0719259.4
Sep. 8, 2008 (GB) ..... 0816368.5

(51) Int. Cl.
*F01P 1/00* (2006.01)
*F01K 25/02* (2006.01)

(52) U.S. Cl.
USPC ..... 60/515; 60/650; 60/659; 60/682

(58) Field of Classification Search
USPC ..... 60/517, 508, 515, 650, 659, 682–683
See application file for complete search history.

(56) References Cited

U.S. PATENT DOCUMENTS

| | | | |
|---|---|---|---|
| 2,633,622 | A | 4/1953 | Robinson et al. |
| 3,310,954 | A | 3/1967 | Sijtstra et al. |
| 3,527,049 | A | 9/1970 | Bush |
| 3,708,979 | A | 1/1973 | Bush et al. |
| 3,818,697 | A | 6/1974 | Gilli |
| 3,977,197 | A | 8/1976 | Brantley, Jr. |
| 3,986,359 | A | 10/1976 | Manning et al. |

(Continued)

FOREIGN PATENT DOCUMENTS

| | | |
|---|---|---|
| CA | 2 512 598 | 1/2007 |
| CN | 1869500 | 11/2006 |

(Continued)

OTHER PUBLICATIONS

U.K. Search Report dated Feb. 21, 2007, 1 page.

(Continued)

*Primary Examiner* — Hoang Nguyen
(74) *Attorney, Agent, or Firm* — Lempia Summerfield Katz LLC

(57) ABSTRACT

Apparatus (10) for storing energy, comprising: compression chamber means (24) for receiving a gas; compression piston means (25) for compressing gas contained in the compression chamber means; first heat storage means (50) for receiving and storing thermal energy from gas compressed by the compression piston means; expansion chamber means (28) for receiving gas after exposure to the first heat storage means; expansion piston means (29) for expanding gas received in the expansion chamber means; and second heat storage means (60) for transferring thermal energy to gas expanded by the expansion piston means. The cycle used by apparatus (10) has two different stages that can be split into separate devices or combined into one device.

20 Claims, 12 Drawing Sheets

(56) References Cited

U.S. PATENT DOCUMENTS

| | | | | |
|---|---|---|---|---|
| 4,094,148 | A | 6/1978 | Nelson | |
| 4,099,557 | A * | 7/1978 | Bricard et al. | 165/104.17 |
| 4,215,553 | A | 8/1980 | Poirier et al. | |
| 4,353,214 | A | 10/1982 | Gardner | |
| 4,397,962 | A | 8/1983 | Schockmel | |
| 4,418,683 | A | 12/1983 | Friefeld et al. | |
| 4,455,825 | A | 6/1984 | Pinto | |
| 4,712,610 | A | 12/1987 | Keston et al. | |
| 4,727,930 | A | 3/1988 | Bruckner et al. | |
| 4,829,282 | A | 5/1989 | Waugh et al. | |
| 4,873,038 | A | 10/1989 | Rapp et al. | |
| 5,329,768 | A * | 7/1994 | Moscrip | 60/518 |
| 5,467,600 | A | 11/1995 | Kuroiwa | |
| 5,634,340 | A | 6/1997 | Grennan | |
| 5,832,728 | A | 11/1998 | Buck | |
| 5,857,436 | A * | 1/1999 | Chen | 123/70 R |
| 5,924,305 | A * | 7/1999 | Hill | 62/467 |
| 6,327,858 | B1 | 12/2001 | Negre et al. | |
| 6,481,215 | B1 * | 11/2002 | Ikegami et al. | 62/6 |
| 6,672,063 | B1 | 1/2004 | Proeschel | |
| 6,817,185 | B2 | 11/2004 | Coney et al. | |
| 6,874,453 | B2 | 4/2005 | Coney et al. | |
| 7,062,914 | B2 | 6/2006 | Wendt et al. | |
| 7,191,596 | B2 * | 3/2007 | Yaguchi et al. | 60/517 |
| 7,284,372 | B2 | 10/2007 | Crow | |
| 7,448,213 | B2 | 11/2008 | Mitani | |
| 7,584,613 | B1 | 9/2009 | Crow | |
| 7,719,127 | B2 | 5/2010 | Bertolotti | |
| 7,723,858 | B2 | 5/2010 | Nayef et al. | |
| 7,877,999 | B2 * | 2/2011 | Nuel et al. | 60/641.13 |
| 7,900,444 | B1 | 3/2011 | McBride et al. | |
| 7,954,321 | B2 | 6/2011 | Shinnar | |
| 2002/0014069 | A1 * | 2/2002 | Holtzapple et al. | 60/39.63 |
| 2003/0101728 | A1 | 6/2003 | Wakana et al. | |
| 2005/0275225 | A1 | 12/2005 | Bertolotti | |
| 2006/0090467 | A1 | 5/2006 | Crow | |
| 2006/0218924 | A1 | 10/2006 | Mitani | |
| 2006/0248886 | A1 * | 11/2006 | Ma | 60/517 |
| 2007/0051103 | A1 | 3/2007 | Bar-Hai | |
| 2007/0220889 | A1 | 9/2007 | Nayef et al. | |
| 2007/0251837 | A1 | 11/2007 | Stach et al. | |
| 2008/0022683 | A1 | 1/2008 | Ohler et al. | |
| 2008/0264062 | A1 | 10/2008 | Prueitt | |
| 2009/0090109 | A1 | 4/2009 | Mills et al. | |
| 2009/0121495 | A1 | 5/2009 | Mills | |
| 2009/0260361 | A1 | 10/2009 | Prueitt | |
| 2010/0192568 | A1 | 8/2010 | Peacock | |
| 2010/0205960 | A1 | 8/2010 | McBride et al. | |
| 2010/0218500 | A1 | 9/2010 | Ruer | |
| 2010/0301614 | A1 | 12/2010 | Ruer | |
| 2011/0056368 | A1 | 3/2011 | McBride et al. | |
| 2011/0100010 | A1 | 5/2011 | Freund et al. | |
| 2011/0100611 | A1 | 5/2011 | Ohler et al. | |
| 2011/0113781 | A1 | 5/2011 | Frey et al. | |
| 2011/0127004 | A1 | 6/2011 | Freund et al. | |
| 2011/0138797 | A1 | 6/2011 | Bollinger et al. | |
| 2011/0139407 | A1 | 6/2011 | Ohler et al. | |
| 2011/0189619 | A1 | 8/2011 | Lloyd | |
| 2011/0204655 | A1 | 8/2011 | Waibel | |
| 2011/0209480 | A1 | 9/2011 | Frazier et al. | |
| 2012/0060501 | A1 | 3/2012 | Hemrle et al. | |
| 2012/0067047 | A1 | 3/2012 | Peterson et al. | |

FOREIGN PATENT DOCUMENTS

| | | |
|---|---|---|
| DE | 403683 | 10/1922 |
| DE | 19527882 | 4/1997 |
| EP | 0 001 410 | 4/1979 |
| EP | 0 003 980 | 9/1979 |
| EP | 1987299 | 11/2008 |
| GB | 2 079 429 | 1/1982 |
| JP | 63253102 | 10/1988 |
| JP | 2004-138043 | 5/2004 |
| KR | 100644407 B | 11/2006 |
| WO | WO 01/33150 | 5/2001 |
| WO | WO 2005/108758 | 11/2005 |
| WO | WO 2006/027438 | 3/2006 |
| WO | WO 2006/072185 | 7/2006 |
| WO | WO 2006/100486 | 9/2006 |
| WO | WO 2007/079245 | 7/2007 |
| WO | WO 2008/148962 | 12/2008 |
| WO | WO 2009/053593 | 4/2009 |
| WO | WO 2009/129170 | 10/2009 |
| WO | WO 2009/152141 | 12/2009 |
| WO | WO 2010/020480 | 2/2010 |
| WO | WO 2010/105155 | 9/2010 |
| WO | WO 2010/115112 | 10/2010 |
| WO | WO 2010/118915 | 10/2010 |
| WO | WO 2010/128224 | 11/2010 |
| WO | WO 2010/145963 | 12/2010 |
| WO | WO 2011/045282 | 4/2011 |
| WO | WO 2011/056855 | 5/2011 |
| WO | WO 2011/079936 | 7/2011 |
| WO | 2011104556 | 9/2011 |

OTHER PUBLICATIONS

U.K. Patentability Search Report, 3 pages.

International Search Report and Written Opinion in International Patent Application No. PCT/GB2008/003336, dated Mar. 30, 2010, 10 pages.

English-language translation of EP 0003980 (a copy of which was submitted on Jun. 17, 2010).

Non-final office action issued in co-pending U.S. Appl. No. 12/753,673, dated Aug. 31, 2012, 13 pages.

Final Office Action in U.S. Appl. No. 12/753,673 dated Nov. 18, 2013.

Final Office Action in U.S. Appl. No. 12/753,673 dated Nov. 26, 2012.

Interview Summary in U.S. Appl. No. 12/753,673 dated Sep. 19, 2013.

Non-Final Office Action in U.S. Appl. No. 12/753,673 dated May 31, 2013.

* cited by examiner

CHARGING ENERGY - COLD SYSTEM

DISCHARGING ENERGY - COLD SYSTEM

ENERGY LOSS - HOT SYSTEM

ENERGY LOSS - COLD SYSTEM

DISCHARGING ENERGY - COLD SYSTEM +ADDED HEAT

DISCHARGING ENERGY - COLD SYSTEM +ADDED HEAT

DISCHARGING ENERGY - COLD SYSTEM (HYBRID)

DISCHARGING ENERGY - COLD SYSTEM (HYBRID)

ENERGY STORAGE

RELATED APPLICATION DATA

This U.S. national phase application is based on international application no. PCT/GB2008/003336, filed on Oct. 3, 2008, which claimed priority to British national patent application no. 0719259.4, filed on Oct. 3, 2007, and to British national patent application no. 0816368.5, filed on Sep. 8, 2008. Priority benefit of these earlier filed applications is hereby claimed.

BACKGROUND

1. Field of the Disclosure

The present invention relates generally to apparatus for energy storage.

2. Description of the Related Art

Current energy storage techniques are either expensive, have poor charge/discharge efficiencies or have unwanted environmental consequences due to the types of chemicals involved or type of land use.

The storage techniques that are currently available that use no chemicals are: pumped hydro storage; flywheel storage; and compressed air energy storage (CAES). These techniques all have certain advantages and disadvantages:

Pumped hydro—require a certain geological set-up and has limited storage capacity. To increase storage requires a large area of land per unit of power stored.

Flywheels—good charge/discharge efficiency, but limited power storage per unit mass and expensive.

Compressed Air Energy Storage—the main drawback of CAES is its reliance on geological structures: the lack of suitable underground caverns substantially limits the usability of this storage method. However, for locations where it is suitable, it can provide a viable option for storing large quantities of energy for long periods. To store compressed air in man-made pressure vessels is problematic since large wall thicknesses are typically required. This means there are no economies of scale using manufactured pressured vessels. In addition, charge/discharge efficiency is not high.

Accordingly, there is a desire to provide an improved way of storing energy which overcomes, or at least alleviates some of the problems associated with the prior art. In particular, there is a desire to provide a cheap, efficient, relatively compact and environmentally inert alternative to current techniques.

SUMMARY

Energy Storage Using Combined Hot and Cold Storage

In accordance with a first aspect of the present invention, there is provided apparatus for storing energy, comprising: compression chamber means for receiving a gas; compression piston means for compressing gas contained in the compression chamber means; first heat storage means for receiving and storing thermal energy from gas compressed by the compression piston means; expansion chamber means for receiving gas after exposure to the first heat storage means; expansion piston means for expanding gas received in the expansion chamber means; and second heat storage means for transferring thermal energy to gas expanded by the expansion piston means.

In this way, energy storage apparatus is provided in which first and second heat storage means are placed within a thermal heat pump cycle to produce a hot and cold store respectively during charging. Energy is then recoverable in a discharging mode by passing gas through the cooled second heat storage means, compressing gas cooled by the second heat storage means, heating the cooled compressed gas by exposing the gas to the heated first heat storage means, and allowing the heated gas to expand by doing work on generator means.

The gas may be air from the surrounding atmosphere. Advantageously, the use of atmospheric air as the working fluid means that there is no need to use potentially polluting coolants. Alternatively, the gas may be nitrogen or a noble gas (e.g. Argon or Helium).

The system base pressure (e.g. the pressure in the second heat storage means) can be varied from sub-atmospheric to above atmospheric. If the system base pressure is raised above atmospheric, then the peak pressure will be increased for a set temperature range and the compression and expansion piston means will become more compact. There is a trade off as the storage vessels will become more expensive in order to deal with the higher pressures. Conversely if the system pressure is sub-atmospheric, then the peak pressures will be lower and the storage vessels will become less expensive against the compression and expansion piston means increasing in size.

The compression may be substantially isentropic or adiabatic. The heat transfer from gas to the first heat storage means may be substantially isobaric. The expansion may be substantially isentropic or adiabatic. The heat transfer from the second heat storage means to the gas may be substantially isobaric. In reality it is not possible to achieve perfect isentropic processes, as irreversibility in the process and heat transfer during the process will occur. Therefore it should be noted that where a process is referred to as isentropic, it should be understood as meaning near or substantially isentropic.

Advantageously, the use of a reciprocating piston compressor/expander can offer significantly improved efficiency over conventional aerodynamic rotary compressors/expanders.

At least one of the first and second heat storage means may comprise a chamber for receiving gas, and particulate material (e.g. a bed of particulate material) housed in the chamber. The particulate material may comprise solid particles and/or fibres packed (e.g. randomly) to form a gas-permeable structure. The solid particles and/or fibres may have a low thermal inertia. For example, the solid particles and/or fibres may be metallic. In another embodiment, the solid particles and/or fibres may comprise a mineral or ceramic. For example, the solid particles may comprise gravel.

The apparatus may further comprise generator means for recovering energy stored in the first and second heat storage means. The generator means may be coupled to one or both of the compression piston means and the expansion piston means. One or both of the compression piston means and the expansion piston means may be configurable to operate in reverse during discharge (e.g. when discharging, the expansion piston means may be configurable to compress cooled gas and the compression piston means may be configurable to allow heated gas to expand).

Energy Buffering Apparatus

In accordance with a second aspect of the present invention, there is provided apparatus for transmitting mechanical power from an input device to an output device, comprising: an energy storage section comprising: first compression chamber means for receiving a gas; first compression piston means for compressing gas contained in the first compression chamber means; first heat storage means for receiving and storing thermal energy from gas compressed by the first compression piston means; first expansion chamber means for receiving gas after exposure to the first heat storage means;

first expansion piston means for expanding gas received in the first expansion chamber means; and second heat storage means for transferring thermal energy to gas expanded by the first expansion piston means; and a heat engine section comprising: second compression chamber means in fluid communication with the second heat storage means and first heat storage means; second compression piston means for compressing gas received in the second compression chamber means for transfer to the first heat storage chamber means; second expansion chamber means in fluid communication with the first heat storage means and the second heat storage means; and second expansion piston means for allowing expansion of gas received in the second expansion chamber from the first heat storage means.

In this way, a thermodynamic transmission system is provided in which energy may be stored in a "buffer" in a first mode of operation when the power output from the system is less than the power supplied and is automatically recovered in a second mode of operation when the power required from the system increases above that of the power supplied. The change between the first and second modes of operation may occur automatically. For example, the apparatus may be configured to react automatically to an imbalance in input and output powers. When the power supplied and used are balanced, the system automatically bypasses the first and second heat storage means.

The gas may be air from the surrounding atmosphere.

The compression provided by the first and second compression piston means may be substantially isentropic or adiabatic. The heat transfer from gas to the first heat storage means may be substantially isobaric. The expansion provided by the first and second expansion piston means may be substantially isentropic or adiabatic. The heat transfer from the second heat storage means to the gas may be substantially isobaric.

At least one of the first and second heat storage means may comprise a chamber for receiving gas, and particulate material (e.g. a bed of particulate material) housed in the chamber. The particulate material may comprise solid particles and/or fibres packed (e.g. randomly) to form a gas-permeable structure. The solid particles and/or fibres may have a low thermal inertia. For example, the solid particles and/or fibres may be metallic. In another embodiment, the solid particles and/or fibres may comprise a mineral or ceramic. For example, the solid particles may comprise gravel.

Energy Storage Using Hot Storage Cycle Only

In accordance with a third aspect of the present invention, there is provided apparatus for storing energy, comprising: compression chamber means for receiving a gas; compression piston means for compressing gas contained in the compression chamber means; heat storage means for receiving and storing thermal energy from gas compressed by the compression piston means; expansion chamber means for receiving gas after exposure to the heat storage means; expansion piston means for expanding gas received in the expansion chamber means; and heat exchanger means for transferring thermal energy (e.g. from atmosphere) to gas expanded by the expansion piston means.

In this way, energy storage apparatus using quasi-isothermal expansion is provided based on the hot storage cycle of the combined cycle of the first aspect of the present invention. Energy is then recoverable in a discharging mode by reversing the cycle.

The gas may be air from the surrounding atmosphere.

The compression may be substantially isentropic or adiabatic. The heat transfer from gas to the heat storage means may be substantially isobaric. The expansion may be substantially isothermal. For example, the expansion piston means may comprise a plurality of expansion stages in series each with a respective heat exchanger associated therewith.

The heat exchanger means may be configured to transfer thermal energy to gas expanded by the expansion piston means during expansion. In this way, a multi-staged expansion stage is provided in order to achieve quasi-isothermal expansion.

In one embodiment, the heat exchanger means is configured to transfer thermal energy to gas expanded by the expansion piston means at one or more stages between discrete expansion steps performed by the expansion piston means. For example, the expansion chamber means may comprise a plurality of expansion chambers connected in series, each expansion chamber having a respective expansion piston means and heat exchanger means associated therewith. Each expansion chamber may have a volume which is smaller than its preceding expansion chamber in the series.

The apparatus may further comprise cold storage means thermally coupled to the heat exchanger means for transferring thermal energy to gas expanded by the expansion piston means. For example, in the case of expansion chamber means comprising a plurality of expansion chambers connected in series, each respective heat exchanger means of the plurality of expansion chambers may be thermally coupled to a single cold storage means. In this way, apparatus is provided for operating a similar reversible cycle to the first embodiment of the present invention, except with a higher temperature stored in the cold storage means.

The heat storage means may comprise a chamber for receiving gas, and particulate material (e.g. a bed of particulate material) housed in the chamber. The particulate material may comprise solid particles and/or fibres packed (e.g. randomly) to form a gas-permeable structure. The solid particles and/or fibres may have a low thermal inertia. For example, the solid particles and/or fibres may be metallic. In another embodiment, the solid particles and/or fibres may comprise a mineral or ceramic. For example, the solid particles may comprise gravel.

The apparatus may further comprise generator means for recovering energy stored in the heat storage means. The generator means may be coupled to one or both of the compression piston means and the expansion piston means. One or both of the compression piston means and the expansion piston means may be configurable to operate in reverse during discharge (e.g. when discharging, the expansion piston means may be configurable to compress gas and the compression piston means may be configurable to allow heated gas to expand).

Energy Storage Using Cold Storage Cycle

In accordance with a fourth aspect of the present invention, there is provided apparatus for storing energy, comprising: compression chamber means for receiving a gas; compression piston means for compressing gas contained in the compression chamber means; heat exchanger means for cooling gas compressed by the compression piston means (e.g. by transferring thermal energy to atmosphere); expansion chamber means for receiving gas after exposure to the heat exchanger means; expansion piston means for expanding gas received in the expansion chamber means; and heat storage means for transferring thermal energy to gas expanded by the expansion piston means.

In this way, energy storage apparatus using quasi-isothermal compression is provided based on the cold storage cycle of the combined cycle of the first aspect of the present invention. Energy is then recoverable in a discharging mode by passing gas through the cooled heat storage means, compressing gas cooled by the heat storage means, and allowing the heated gas to expand by doing work on generator means.

The gas may be air from the surrounding atmosphere.

The compression may be substantially isothermal. For example, the compression piston means may comprise a plurality of compression stages in series each with a respective heat exchanger associated therewith. The heat transfer from gas to the heat storage means may be substantially isobaric. The expansion may be substantially isentropic or adiabatic.

The heat exchanger means may be configured to cool gas compressed by the compression piston means during compression. In this way, a multi-staged compression stage is provided in order to achieve quasi-isothermal compression.

In one embodiment, the heat exchanger means is configured to cool gas compressed by the compression piston means at one or more stages between discrete compression steps performed by the compression piston means. For example, the compression chamber means may comprise a plurality of compression chambers connected in series, each compression chamber having a respective compression piston means and heat exchanger means associated therewith. Each compression chamber may have a volume which is larger than its preceding compression chamber in the series.

The apparatus may further comprise warm storage means thermally coupled to the heat exchanger means for receiving and storing thermal energy from gas compressed by the compression piston means. For example, in the case of compression chamber means comprising a plurality of compression chambers connected in series, each respective heat exchanger means of the plurality of compression chambers may be thermally coupled to a single warm storage means. In this way, apparatus is provided for operating a similar reversible cycle to the first embodiment of the present invention, except with a lower temperature stored in the warm storage means.

The heat storage means may comprise a chamber for receiving gas, and particulate material (e.g. a bed of particulate material) housed in the chamber. The particulate material may comprise solid particles and/or fibres packed (e.g. randomly) to form a gas-permeable structure. The solid particles and/or fibres may have a low thermal inertia. For example, the solid particles and/or fibres may be metallic. In another embodiment, the solid particles may comprise a mineral or ceramic. For example, the solid particles may comprise gravel.

The apparatus may further comprise generator means for recovering energy stored in the heat storage means. The generator means may be coupled to one or both of the compression piston means and the expansion piston means. One or both of the compression piston means and the expansion piston means may be configurable to operate in reverse during discharge (e.g. when discharging, the expansion piston means may be configurable to compress cooled gas and the compression piston means may be configurable to allow heated gas to expand).

BRIEF DESCRIPTION OF THE DRAWINGS

Embodiments of the present invention will now be described by way of example with reference to the accompanying drawings in which:

FIG. 1 shows an arrangement in which thermal storage means are inserted within a thermal heat-pump/engine cycle. The cycle used has two different stages that can be split into separate devices or combined into one device.

Figure 5:
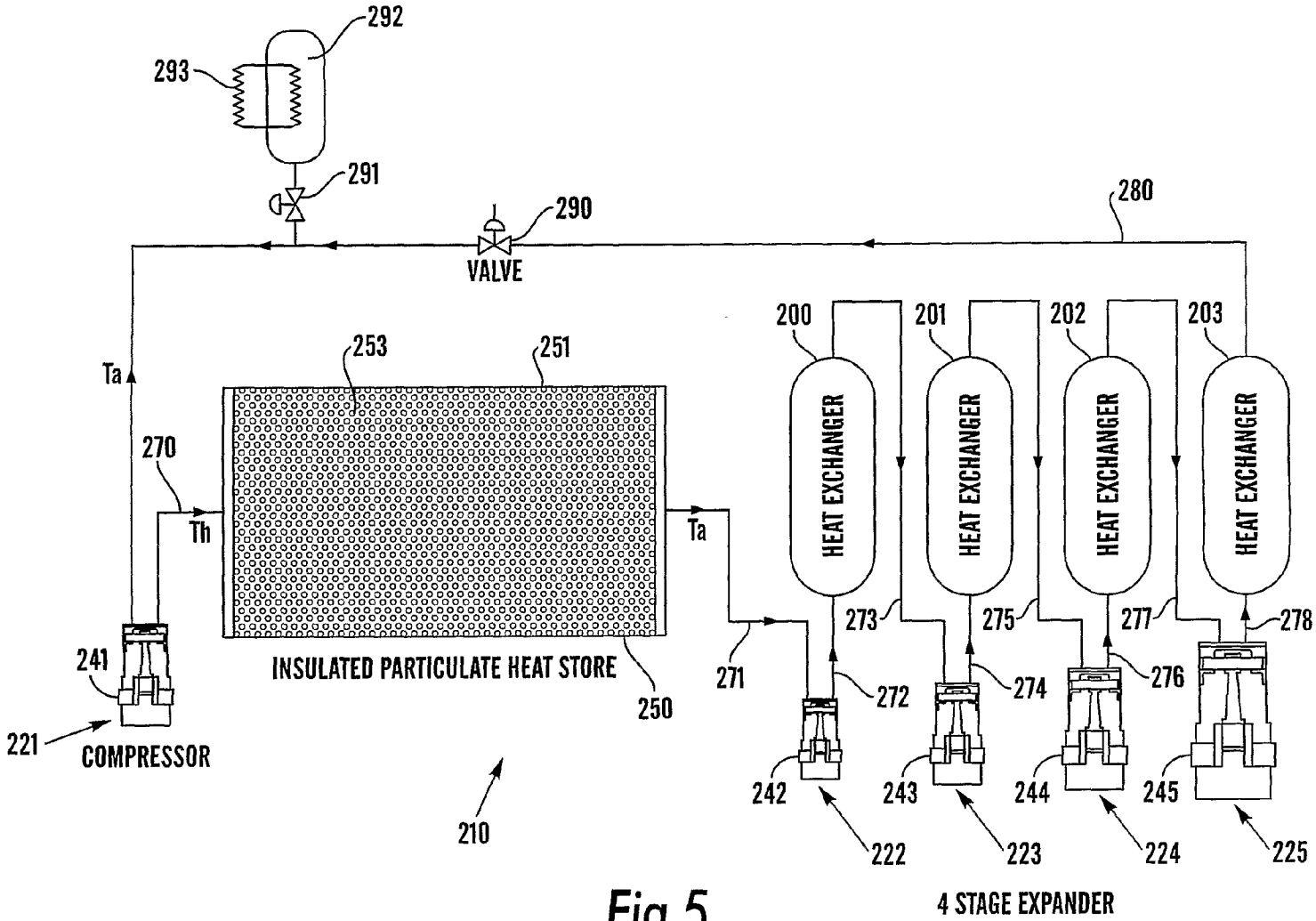
FIG. 5 is a schematic illustration of a first embodiment of energy storage apparatus according to the third aspect of the present invention.

Hot Storage Only (FIG. 5)

FIG. 5 shows a device configured to provide substantially isentropic compression of the working fluid (e.g. air) a compressor, in this case a reciprocating device, which raises the temperature and pressure. The working fluid then passes through a particulate thermal storage medium (e.g. gravel or metallic granules) where it is cooled back to near ambient temperatures. The working fluid is then isothermally expanded back to atmospheric temperature. This will be done using multiple stages expanders (again, in this case, reciprocating) and intercoolers (warmers).

As discussed in more detail below, to recover the energy you simply reverse the cycle.

If the isothermal expansion and compression were perfect there would be no energy losses in the charging and discharging. However, in practice the series of compressors/expanders will produce intercooling/warming. With reference to the PV charts, it is noted that this will immediately introduce losses into the system that cannot be recovered. The fewer stages provided, the larger the losses. The more stages provided, the more complex and expensive the equipment.

The energy density of the storage is a function of temperature, which is also a direct function of the pressure. Pressure vessels load limits are directly related to the wall material's tensile strength (which drops with increased temperature). Pressure vessels require a certain mass of material per unit area to confine a pressurised fluid. If the area of a pipe is doubled, the mass of material in the walls will be doubled.

Consequently normal pressurised storage will always cost more than unpressurised storage and there are no economies of scale.

Figure 6:
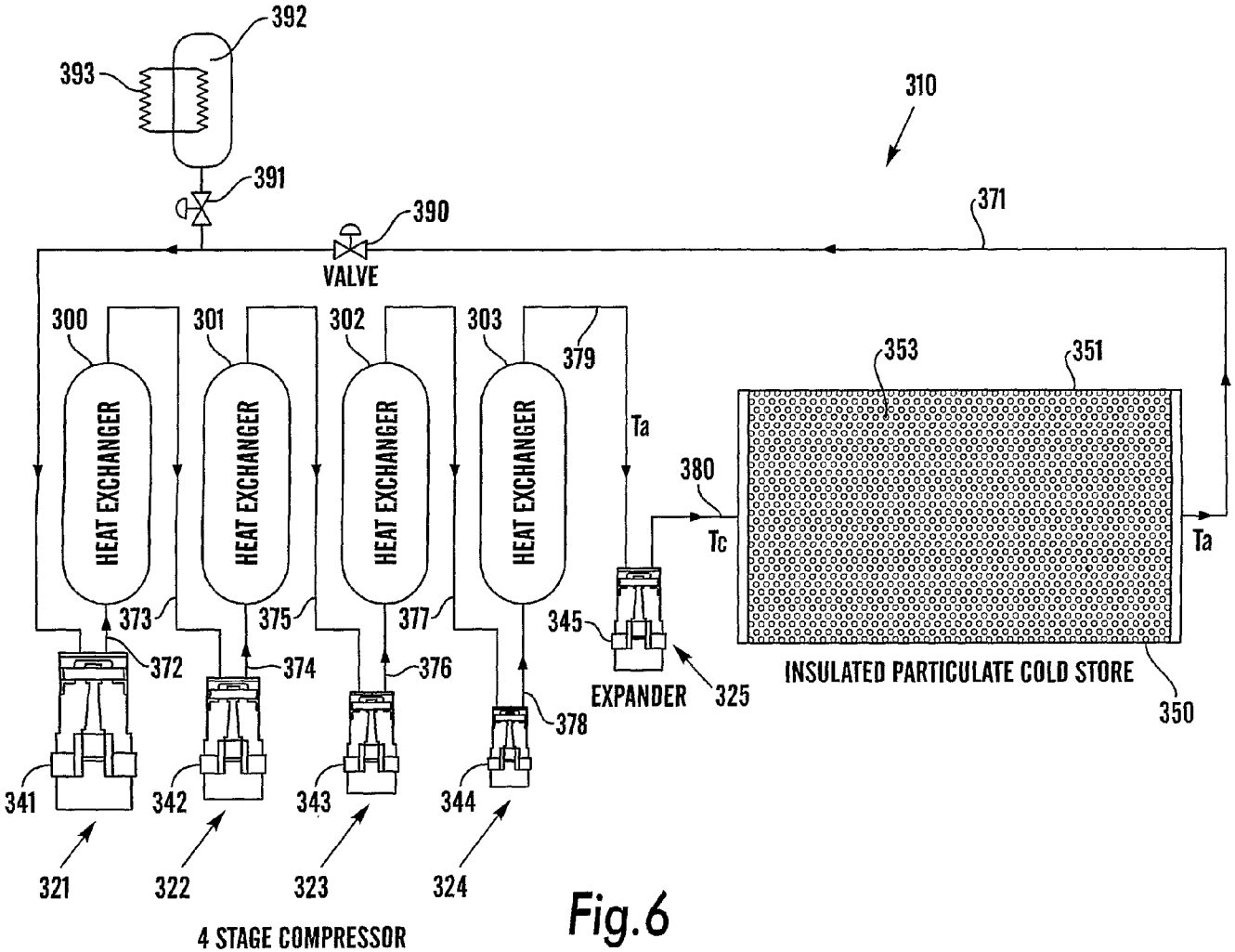
FIG. 6 is a schematic illustration of a first embodiment of energy storage apparatus according to the fourth aspect of the present invention.

Cold Storage Only (FIG. 6)

FIG. 6 shows a device configured to provide substantially isothermal compression of the working fluid (e.g. air), using a compressor, in this case a reciprocating device, to increase pressure of the working Compression is followed by substantially isentropic expansion of the working fluid to lower its temperature below ambient and the pressure back to atmospheric. The working fluid then passes through a particulate thermal storage medium (e.g. gravel or metallic granules) where it is warmed back to near ambient temperatures. The isothermal compression is achieved using multiple stage compressors and intercoolers.

As discussed in more detail below, to recover the energy you simply reverse the cycle.

If the isothermal compression and expansion were perfect there would be no energy losses in the charging and discharging. However, the reality is that you will have a series of compressors/expanders with intercooling/warming. You can see on the pV chart that this will immediately introduce losses into the system that cannot be recovered. The fewer stages you have the larger the losses. The more stages you have the more complex and expensive the equipment.

Either waste heat from another source (such as a power station) or low grade thermal heat from the sun can be used to boost the energy recovered during the energy recovery phase of the process. The benefit of this 'energy boost' should outweigh the losses introduced by the isothermal compression/expansion stage of the process.

Figure 1:
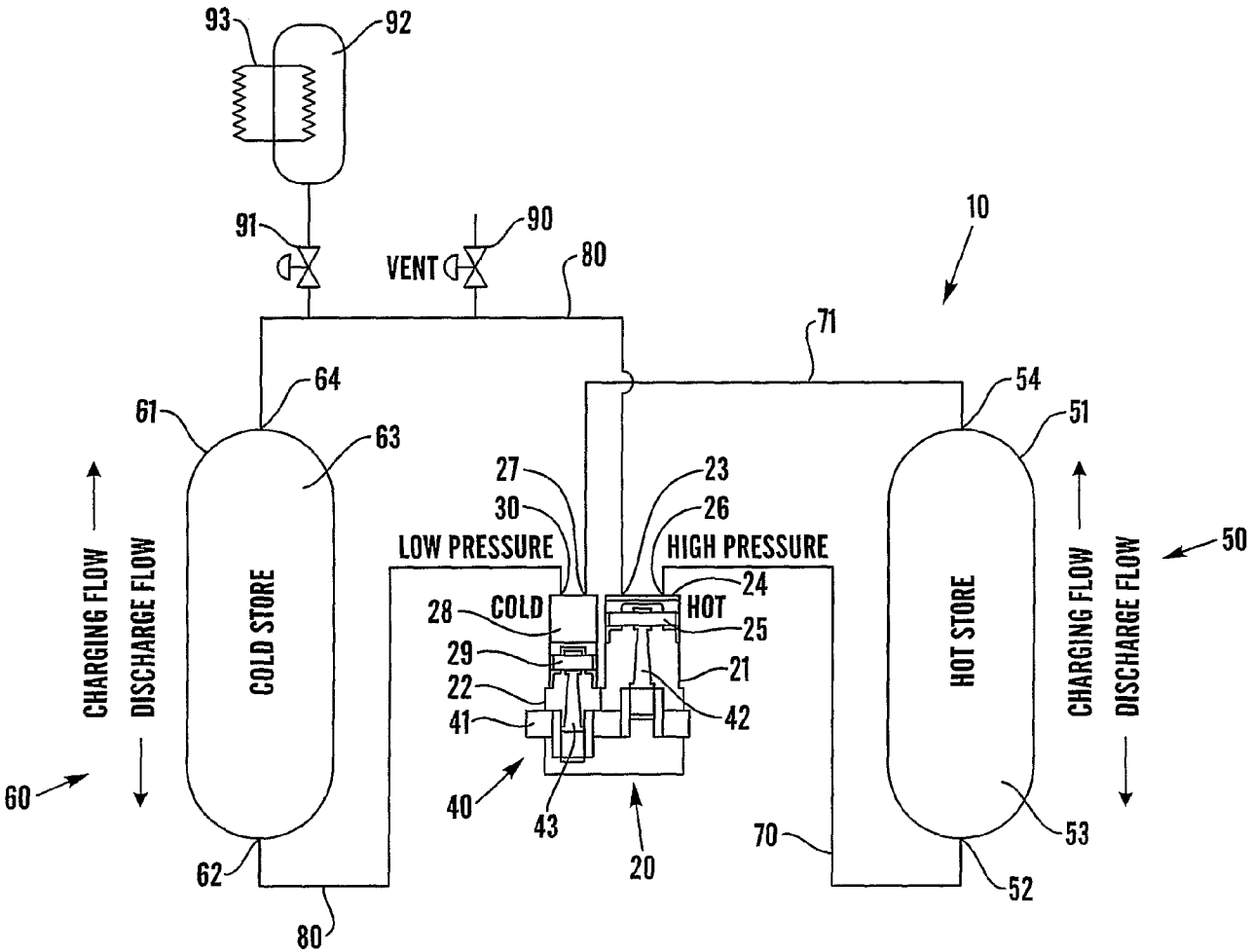
FIG. 1 is a schematic illustration of energy storage apparatus according to the first aspect of the present invention.

Hot and Cold Storage Combined (FIG. 1)

FIG. 1 shows a device for the combined cycle which employs substantially isentropic compression, using a compressor, in this case a reciprocating device, which raises the temperature and pressure of the working fluid (e.g. air). The working fluid then passes through a particulate thermal storage medium (potentially gravel or metallic granules) where it is cooled. It is then expanded to cool it and lower the pressure before it passes through another particulate store, where it is warmed back to ambient and then back to step one.

To discharge working fluid passes through the second heat storage to 2, is compressed to 3, warms via the first heat storage to 4, expands back to 1.

This device automatically has the advantage of avoiding the need for any isothermal compression or expansion. This means that the inevitable losses associated with the charge/discharge of the hot only or cold only devices can be avoided. It is inherently more efficient.

Cycle Analysis

Mechanical energy/cycle: (charging)

Isentropic compression:

$$E_{4\to 2} = \frac{p_1 V_1^{\gamma}}{1-\gamma}\left(V_2^{1-\gamma} - V_1^{1-\gamma}\right)$$

Cool from 2 to 3:

$$E_{2\to 3} = p_2(V_3 - V_2)$$

Where: $V_2 = V_1(p_2/p_1)^{-1/\gamma}$ $V_3 = V_2(T_3/T_2)^{1/(1-\gamma)}$ $T_2 = T_1(V_2/V_1)^{1-\gamma}$ $T_3$ approx$=T_1$ Expand from 3 to 4:

$$E_{3\to 4} = \frac{p_2 V_3^{\gamma}}{1-\gamma}\left(V_4^{\gamma-1} - V_3^{\gamma-1}\right)$$

where $V_4 = V_3^{\gamma}(p_4/p_3)^{-1/\gamma}$

Warm from 4 to 1:

$$E_{4\to 1} = p_1(V_1 - V_4)$$

Mass of fluid involved per cycle:

M=pV/RT (equation of state)

Thermal energy stored:

$$E_{T(2\to 3)} = M \cdot C_p(T_2 - T_3)$$

$$E_{T(1\to 4)} = M \cdot C_p(T_1 - T_4)$$

Ratio of mechanical to thermal storage;

$$= \frac{E_{1\to 2} + E_{2\to 3} + E_{3\to 4} + E_{4\to 1}}{E_{T(2\to 3)} + E_{T(1\to 4)}}$$

As this cycle is theoretically reversible high efficiencies should be achievable.

Uses of Concept

Figure 4:
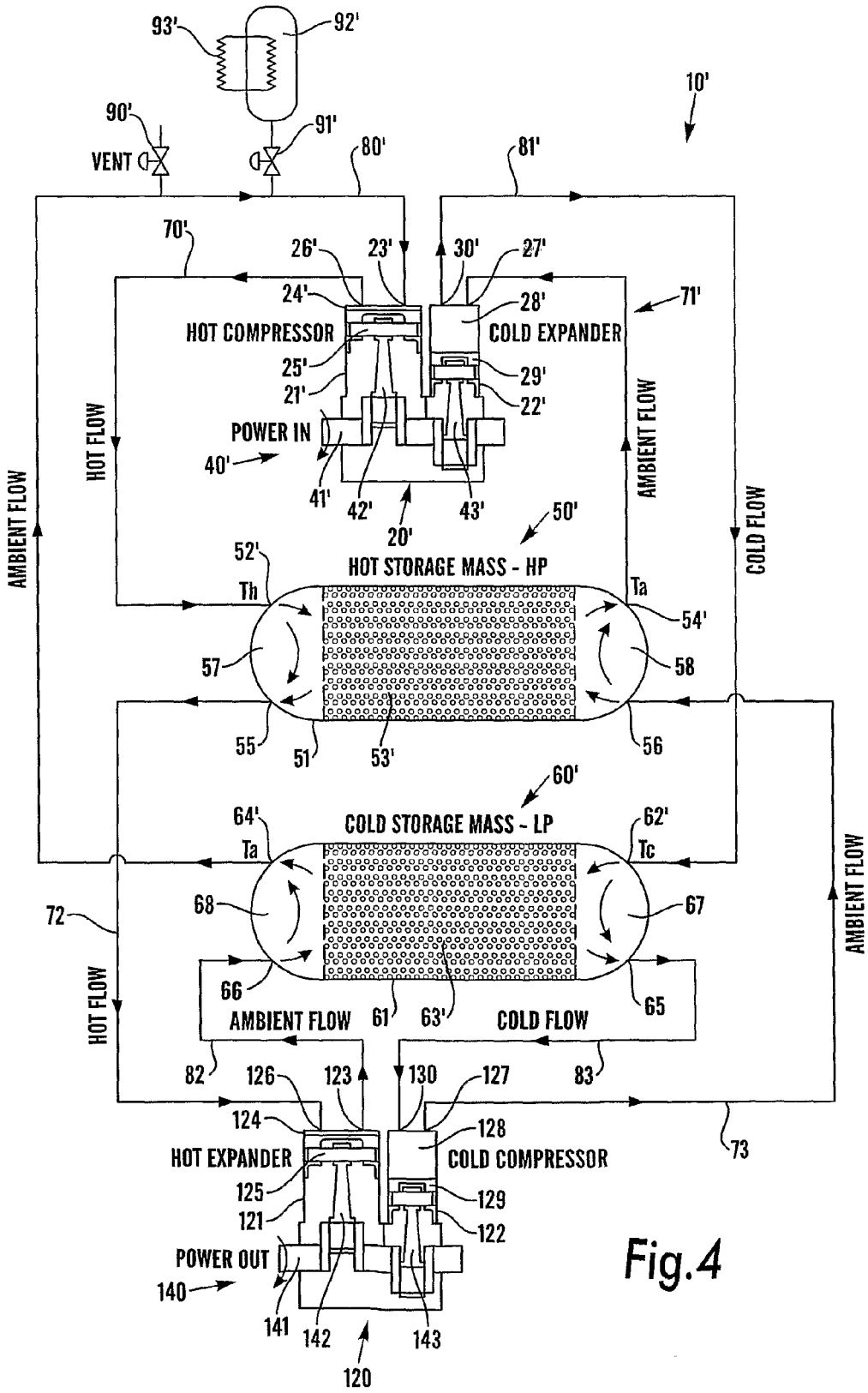
FIG. 4 is a schematic illustration of transmission apparatus incorporating energy storing apparatus according to the second aspect of the present invention.

In FIG. 4, apparatus is shown linking two thermodynamic machines with an energy store, such that the energy input is completely independent of action from the output. This transforms the device into a form of thermodynamic transmission with the ability to store a significant amount of energy.

In the embodiment illustrated, all plumbing must be highly insulated with the exception of the Ta pipes which should be exposed to maintain the datum.

This set up automatically bypasses the storage mass if power supplied equals the power removed, any imbalance gives seamless and automatic transfer of energy to and from the buffer.

The key principle is that energy addition or removal is solely a function of the relative rates of gas flow through the input and output devices, If these are equal then no energy enters of leaves the store, if the input flow is greater then energy is stored, if the output flow is greater, energy leaves the store.

To avoid an overall rise in system entropy at least one ambient flow must be cooled. This could be achieved by opening the Ta (ambient) end of the second heat storage to the atmosphere such that the cold side is then at ambient pressure. If the entire device is worked at elevated pressure it may be made more compact, this may have application in transport for hybrid vehicles and the like.

For bulk storage of energy it will be desirable to store at ambient pressure, this may be achieved by passing the pressurised flows from the machinery through heat exchangers at the ends of the storage masses and blowing ambient pressure air through the stores via these heat exchangers.

Where a heat exchanger and unpressurised store is used it is likely that there will be a temperature drop associated with each transfer stage. For example the air might leave the hot compressor at 500 deg C. This air will be run through the heat exchanger and might enter the unpressurised hot store at about 450 deg C. When the system is reversed the air temperature will only be heated to approximately 400 deg C. In this situation it can be beneficial to supplement the heat in the unpressurised store with some external heat source, such as electricity or gas.

Because this heat is added at a high temperature there is a significant benefit in terms of increasing the energy density of the store and the recoverable energy upon discharge. For example in the example given the store might be heated to 550 deg C. and the return flow of air during the discharge cycle would be reheated to its original temperature of 500 deg C.

In addition this heating can be used to maintain the temperature of the store if it is left undischarged for long periods of time. This has particular application in UPS or standby power duties Pressurised bulk storage may be achieved by placing the storage volumes underground at significant depth, for example old mines could be used. The mass of the earth above may then be used to balance the high gas pressures within the store.

Additional Cycles where it can be inserted in the thermal heat-pump/engine cycle.

Cold Storage Only

Energy In:

Isothermal compression of gas at ambient temperature and pressure (raises pressure of gas), isentropic expansion back to atmospheric pressure (cools gas below ambient temperature), isobaric heating back to ambient temperature (transfers heat from store to gas). This cycle is theoretically reversible, although the isothermal compression is likely to consist of a series of compressions that are near isentropic rather than isothermal with cooling after each stage. This will make this cycle inherently less efficient than the combined hot and cold storage, although it has the very significant cost advantage that the entire store is at ambient pressure. In addition it should be noted that where isothermal compression or expansion is referred to this means as near isothermal as possible and may involve a number of compression or expansion stages.

Energy Out:

Charge of air at ambient pressure and temperature is run through the second heat storage and cooled. It is then isentropically compressed to raise its temperature to ambient (near at least) and its pressure is now high. It is then expanded and heated back to ambient in a multi-stage expander with heat exchangers between each stage.

Cold Storage with Low Grade Heat Addition in the Recovery Stage

This takes the previous cold only cycle and combines it with a low grade form of heat that can be used to boost the energy recovery process. This low grade heat could be from a power station or from a solar collector.

Energy In:

Isothermal compression of gas at ambient temperature and pressure (raises pressure of gas), isobaric cooling of gas to ambient temperature, isentropic expansion back to atmospheric pressure (cools gas below ambient temperature), isobaric heating back to ambient temperature (transfers heat from store to gas). This cycle is theoretically reversible, although the isothermal compression is likely to consist of a series of isentropic compressions with cooling after each stage.

Energy Out:

Low Level Heat is supplied at a temperature above ambient called 'ambient plus'.

Charge of air at ambient pressure and temperature is run through the second heat storage and cooled. It is then isentropically compressed to raise its temperature to ambient (near at least) and its pressure is now high. This air is then run through a heat exchanger with a counter flow of, for example, hot water from the power station at 'ambient plus'. This water is cooled as the air is heated until the air is almost at 'ambient plus'. At this point it is isentropically expanded back to ambient temperature and pressure (or there about).

DETAILED DESCRIPTION OF THE FIGURES

FIG. 1

FIG. 1 shows an energy storage system 10 comprising: compressor/expander means 20 including compressor means 21, expander means 22, and power input/output means 40; first heat storage means 50, second heat storage means 60, high pressure transfer means 70,71 and low pressure transfer means 80,81. In this diagram the compressor/expander means 20 is shown as a single unit.

The compressor means 21 comprises: low pressure inlet means 23; a compression chamber 24; compression piston means 25; and high pressure exhaust means 26. In this example, the compressor means 21 is configured to run in reverse and operate as an expander means in the discharging phase of the cycle. There are two other alternative ways of achieving expansion in the discharging phase: (1) switching the flows when the system is reversed so that the compressor means 21 is only used for compressing gas and the expander means 22 for expanding gas, but this has the disadvantage of incorrect cylinder sizing; and (2) providing a separate compressor/expander for the discharge part of the cycle with suitable switching of the flow.

The expander means 22 comprises: high pressure inlet means 27; an expansion chamber 28; expansion piston means 29; and low pressure exhaust means 30. In this example, the expander means 22 is configured to run in reverse and operate as a compressor means in the discharging phase of the cycle. There are two other ways of achieving expansion in the discharging phase: (1) switching the flows when the system is reversed so that the compressor means 21 is only used for compressing gas and the expander means 22 for expanding gas, but this has the disadvantage of incorrect cylinder sizing; and (2) providing a separate compressor/expander for the discharge part of the cycle with suitable switching of the flow.

The power input/output means 40 comprises a mechanical link from an energy source/demand 41, a driving mechanism to the compressor 42, and a driving mechanism to the expander 43. The energy source/demand 41 is an energy source when used in power input mode or an energy demand when used in power output mode.

The first heat storage means 50 comprises a first insulated pressure vessel 51 suitable for the high pressure, a high pressure inlet/outlet 52, a first thermal store 53 and a high pressure inlet/outlet 54.

The second heat storage means 60 comprises a second insulated pressure vessel 61 suitable for the low pressure, a low pressure inlet/outlet 62, a second thermal store 63 and a low pressure inlet/outlet 64.

To charge the system 10, a low pressure gas in the low pressure transfer means 80 enters the compressor means 21 via the low pressure inlet means 23 and is allowed to pass into the compression chamber 24. Once the gas has entered the compression chamber 24, the low pressure inlet means 23 are sealed and the compression piston means 25 is then actuated by driving mechanism 42. Once the gas contained in the compression chamber 24 has been compressed by the compression piston means 25 up to approximately the level in the high pressure transfer means 70, the gas is transferred to the high pressure transfer means 70 by opening the high pressure exhaust means 26.

The gas is transferred by the high pressure transfer means 70 to the first heat storage means 50. The gas enters the first heat storage means 50 through the high pressure inlet/outlet means 52 and passes through the first thermal store 53, which is enclosed within the first insulated pressure vessel 51. As the gas passes through the first thermal store 53 it transfers thermal energy to the first thermal store 53 and leaves the first heat storage means 50 through the high pressure inlet/outlet means 54. The gas now passes through the high pressure transfer means 71 and enters the expander means 22 through the high pressure inlet means 27.

The high pressure gas entering the expander means 22 via the high pressure inlet means 27 is allowed to pass into the expansion chamber 28. Once the gas has entered the expansion chamber 28, the high pressure inlet means 27 are sealed and the expansion piston means 29 is then actuated by driving mechanism 43. Once the gas contained in the expansion chamber 28 has been expanded by the expansion piston means 29 down to approximately the level in the low pressure transfer means 81, the gas is transferred to the low pressure transfer means 81 by opening the low pressure exhaust means 30.

The gas is transferred by the low pressure transfer means 81 to the second heat storage means 60. The gas enters the second heat storage means 60 through the low pressure inlet/outlet means 62 and passes through the second thermal store 63, which is enclosed within the second insulated pressure vessel 61. As the gas passes through the second thermal store 63 it receives thermal energy from the second thermal store 63 and leaves the second heat storage means 60 through the low pressure inlet/outlet means 64. The gas now passes through the low pressure transfer means 80 and is available to enters the compressor means 21 through the low pressure inlet means 23.

This process can be run until the first and second heat storage means 50,60 are fully charged, after which no more energy can be stored in the system. To discharge the system, the process is reversed and the compressor means operates as an expander and the expander means 22 operates as a compressor. The flows through the system are reversed and once the system has discharged, the temperatures throughout the system will be approximately returned to that at which they started.

If the gas is air and the low pressure is set at atmospheric pressure then it is likely that there will be a vent 90 or 91 located within the low pressure transfer means 80. The vent 90 allows ambient air to enter and leave the system as necessary and prevents a rise in entropy of the system. If the gas is not air and/or the low pressure is not atmospheric pressure then the vent 91 will lead to a reservoir of the gas 92 that may be kept at a stable temperature by means of a heat exchanger 93. If no heat exchanger is used and/or the gas is not vented to atmosphere then there will be a steady rise in the entropy (and hence temperature) of the system.

Figure 2:
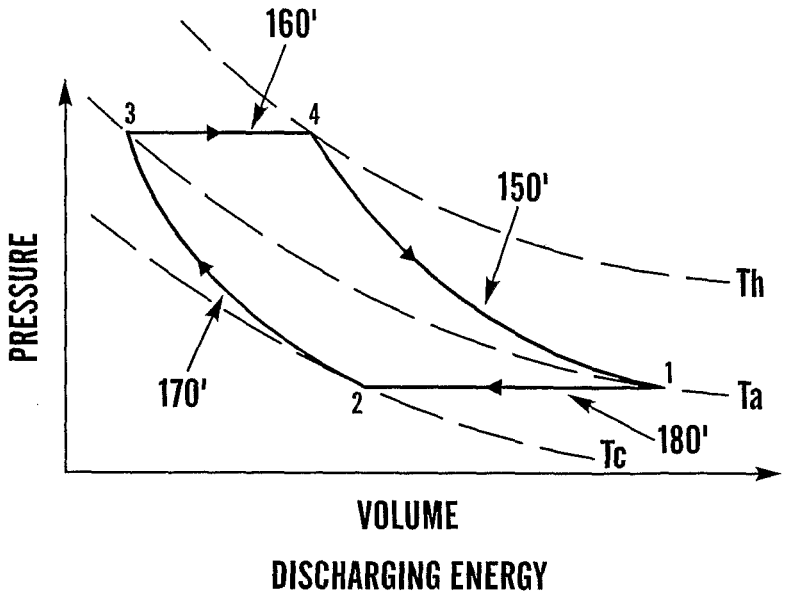
FIG. 2 shows a P-V diagram modelling a typical cycle of the apparatus of FIG. 1 during discharging.

FIG. 2 Discharging System in FIG. 1

FIG. 2 shows an idealised P-V (pressure plotted against volume) diagram for energy store 10 in the discharging phase. The straight portion 180' represents isobaric cooling of the gas flow from, in this example, ambient temperature and pressure as it passes through second heat storage means 60; curve 170' at the left-hand side of the diagram represents an isentropic compression in the expander means 22; the straight portion 160' represents isobaric heating of the flow as it passes through the first heat storage means 50; and curve 150' at the right-hand side of the diagram represents an isentropic expansion of the gas in the compressor means 21. The recoverable work is equal to the shaded area inside the lines. Of course, the real P-V diagram is likely to exhibit some differences from the idealized cycle due to irreversible processes occurring within the real cycle. In addition, as has already been mentioned, the low pressure part of the cycle can be either above or below atmospheric pressure, the gas does not have to be air and the low (T1) temperature can also be set above or below ambient temperature.

Figure 3:
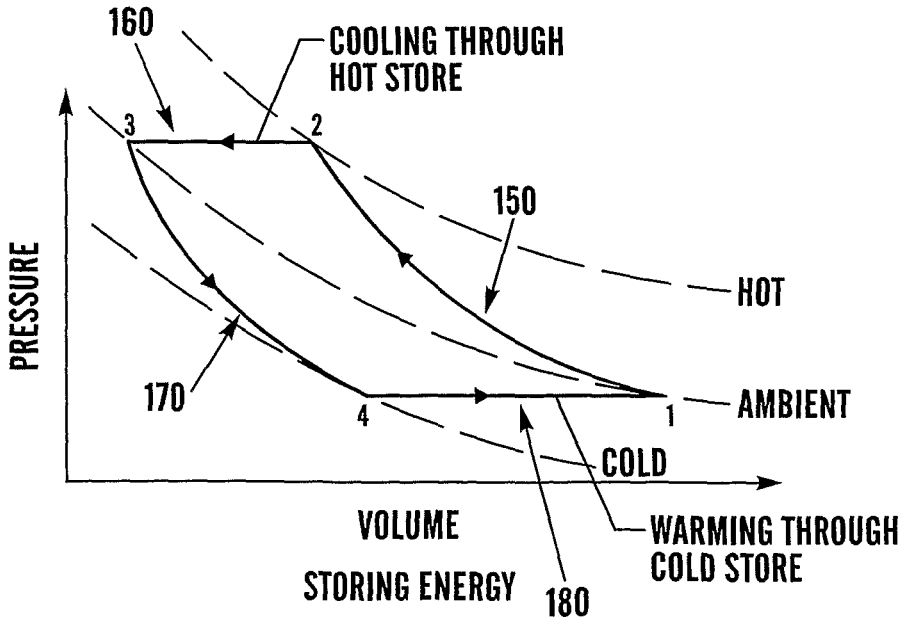
FIG. 3 shows a P-V diagram modelling a typical cycle of the apparatus of FIG. 1 during charging.

FIG. 3 Charging System in FIG. 1

FIG. 3 shows an idealised P-V (pressure plotted against volume) diagram for energy store 10 in the charging phase. Curve 150 at the right-hand side of the diagram represents an isentropic compression of the gas flow in the compressor means 21 from, in this example, ambient temperature and pressure; the straight portion 160 represents isobaric cooling of the flow as it passes through the first heat storage means 50; curve 170 at the left-hand side of the diagram represents an isentropic expansion back to atmospheric pressure in the expander means 22; and the straight portion 180 represents isobaric heating of the flow as it passes through the second heat storage means 60 back to ambient temperature. The work done and hence the mechanical work stored is equal to the shaded area inside the lines. Of course, the real P-V diagram is again likely to exhibit some differences from the idealized cycle due to irreversible processes occurring within the real cycle. In addition, as has already been mentioned, the low pressure part of the cycle can be either above or below atmospheric pressure, the gas does not have to be air and the low (T1) temperature can also be set above or below ambient temperature.

FIG. 4—Energy Storage and Transmission

FIG. 4 shows an energy storage system 10' comprising: first compressor/expander means 20' including first compressor means 21' and first expander means 22'; second compressor/expander means 120 including second expander means 121 and second compressor means 122; power input means 40; power output means 140; first heat storage means 50'; second heat storage means 60'; high pressure transfer means 70',71',72 and 73; and low pressure transfer means 80',81',82 and 83.

The first compressor means 21' comprises: low pressure inlet means 23'; a first compression chamber 24'; first compression piston means 25'; and high pressure exhaust means 26'.

The first expander means 22' comprises: high pressure inlet means 27'; a first expansion chamber 28'; first expansion piston means 29'; and low pressure exhaust means 30'.

The second expander means 121 comprises: low pressure outlet means 123; a second expansion chamber 124; second expansion piston means 125; and high pressure inlet means 126.

The second compressor means 122 comprises: high pressure outlet means 127; a second compression chamber 128; second compression piston means 129; and low pressure inlet means 130.

The power input means 40' comprises: a mechanical link from an energy source 41'; a driving mechanism 42' to the first compression piston means 25'; and a driving mechanism 43' to the first expansion piston means 29'.

The power output means 140 comprises: a mechanical link from an energy demand 141; a driving mechanism 142 to the second expansion piston means 125; and a driving mechanism 143 to the second compression piston means 129.

The first heat storage means 50' comprises a first insulated pressure vessel 51' suitable for the high pressure, high pressure inlet means 52',56, high pressure outlet means 54' and 55, hot distribution chamber 57, first ambient distribution chamber 58 and a first thermal store 53'.

The second heat storage means 60' comprises a second insulated pressure vessel 61' suitable for the low pressure, low pressure inlet means 62',66, low pressure outlet means 64' and 65, cold distribution chamber 67, second ambient distribution chamber 68 and a second thermal store 63'.

Assuming there is sufficient energy stored in the first and second heat storage means 50' and 60', then there are only five possible modes of operation:

1. Charging Only. If no energy is being extracted by the power output means 140 and energy is being added by the power input means 40' then the flow will charge the first and second heat storage means 50' and 60'.
2. Part Charging and Part Direct Flow. If less energy is being extracted by the power output means 140 than is being supplied by the power input means 40' then the flow will split with drive the compressor/expander means 120 must be drawn from the first and second heat storage means 50' and 60'.

If the first and second heat storage means 50' and 60' are run down then the only options available are (1) to (3) until there is some charge added to the system.

Mode (1)—Charging Only

In this scenario the power input is being used purely to charge the first and second heat storage means 50' and 60'. It is identical to the situation of charging the device shown in FIG. 1. In this configuration the power is being input only and there is therefore no need to consider any flow through the second compressor means 121 and second expander means 122.

In use, a low pressure gas in the low pressure transfer means 80' enters the first compressor means 21' via the low pressure inlet means 23' and is allowed to pass into the first compression chamber 24'. Once the gas has entered the first compression chamber 24', the low pressure inlet means 23' are sealed and the first compression piston means 25' is then actuated by driving mechanism 42'. Once the gas contained in the compression chamber 24' has been compressed by the compression piston means 25' up to approximately the level in the high pressure transfer means 70', the gas is transferred to the high pressure transfer means 70' by opening the high enough of the flow going to supply the power output requirements of the compressor/expander means 120 and the remaining flow will charge the first and second heat storage means 50' and 60'. This can be analysed as a combination of (1) and (3).

3. Direct Flow. If the same energy is being extracted by the power output means 140 as is being supplied by the power input means 40' then almost all of the flow will bypass the first and second heat storage means 50' and 60' and pass directly from the compressor means 21' to the expander means 121 and also the expander means 22' to the compressor means 122.
4. Part Direct Flow and Part Discharging. If more energy is being extracted by the power output means 140 than is being supplied by the power input means 40' then the flow from the compressor/expander means 20' will pass directly through the system as for case (3) and there will be an additional flow which will be drawn from the first and second heat storage means 50' and 60'. This additional flow should combine with the direct flow to equal the power output required. This can be analysed as a combination of (3) and (5).
5. Discharging Only. If no power is being supplied by the power input means 40' then all of power to pressure exhaust means 26'.

The gas is transferred by the high pressure transfer means 70' to the hot distribution chamber 57. The gas enters the hot distribution chamber 57 through the high pressure inlet means 52'. Gas leaves the hot distribution chamber 57 and passes through the first thermal store 53', which is enclosed within the first insulated pressure vessel 51'. As the gas passes through the first thermal store 53' it transfers thermal energy to the first thermal store 53' and enters the first ambient distribution chamber 58. It then leaves the first ambient distribution chamber 58 through the high pressure outlet means 54'. The gas now passes through the high pressure transfer means 71' and enters the first expander means 22' through the high pressure inlet means 27'.

The high pressure gas entering the first expander means 22' via the high pressure inlet means 27' is allowed to pass into the first expansion chamber 28'. Once the gas has entered the first expansion chamber 28', the high pressure inlet means 27' are sealed and the first expansion piston means 29' is then actuated by driving mechanism 43'. Once the gas contained in the first expansion chamber 28' has been expanded by the first expansion piston means 29' down to approximately the level in the low pressure transfer means 81', the gas is transferred to the low pressure transfer means 81' by opening the low pressure exhaust means 30'.

The gas is transferred by the low pressure transfer means 81' to the second heat storage means 60'. The gas enters the cold distribution chamber 67 through the low pressure inlet means 62' and passes through the second thermal store 63', which is enclosed within the second insulated pressure vessel 61'. As the gas passes through the second thermal store 63' it receives thermal energy from the second thermal store 63' and then enters the second ambient distribution chamber 68. The gas leaves the second ambient distribution chamber 68 through the low pressure outlet means 64'. The gas now passes through the low pressure transfer means 80' and is available to enter the first expander means 21' through the low pressure inlet means 23'.

If the gas is air and the low pressure is set at atmospheric pressure then it is likely that there will be a vent 90' or 91' located within the low pressure transfer means 80'. The vent 90' allows ambient air to enter and leave the system as necessary and prevents a rise in entropy of the system. If the gas is not air and/or the low pressure is not atmospheric pressure then the vent 91' will lead to a reservoir of the gas 92' that may be kept at a stable temperature by means of a heat exchanger 93'. If no heat exchanger is used and/or the gas is not vented to atmosphere then there will be a steady rise in the entropy (and hence temperature) of the system.

Mode (3)—Direct Flow

In this scenario the power input is being used to directly drive the power output without any significant flows through the first and second heat storage means 50' and 60'.

In use, a low pressure gas in the low pressure transfer means 80' enters the first compressor means 21' via the low pressure inlet means 23' and is allowed to pass into the first compression chamber 24'. Once the gas has entered the first compression chamber 24', the low pressure inlet means 23' are sealed and the first compression piston means 25' is then actuated by driving mechanism 42'. Once the gas contained in the compression chamber 24' has been compressed by the compression piston means 25' up to approximately the level in the high pressure transfer means 70', the gas is transferred to the high pressure transfer means 70' by opening the high pressure exhaust means 26'.

The gas is transferred by the high pressure transfer means 70' to the hot distribution chamber 57. The gas enters the hot distribution chamber 57 through the high pressure inlet means 52'. The gas leaves the hot distribution chamber 57 and passes through the high pressure outlet 55 into the high pressure transfer means 72. The gas now passes through the high pressure transfer means 72 and enters the second expander means 121 through the high pressure inlet means 126.

The high pressure gas entering the second expander means 121 via the high pressure inlet means 126 is allowed to pass into the second expansion chamber 124. Once the gas has entered the second expansion chamber 124, the high pressure inlet means 126 are sealed and the second expansion piston means 125 is then actuated by driving mechanism 142. Once the gas contained in the second expansion chamber 124 has been expanded by the second expansion piston means 125 down to approximately the level in the low pressure transfer means 82, the gas is transferred to the low pressure transfer means 82 by opening the low pressure exhaust means 123.

The gas is transferred by the low pressure transfer means 82 to the second heat storage means 60'. The gas enters the second ambient distribution chamber 68 through the low pressure inlet means 66 and leaves immediately through the low pressure outlet 64'. The gas now passes through the low pressure transfer means 80' and is available to enter the first compressor means 21' through the low pressure inlet means 23'.

In addition, a cold low pressure gas in the low pressure transfer means 83 enters the second compressor means 122 via the low pressure inlet means 130 and is allowed to pass into the second compression chamber 128. Once the gas has entered the second compression chamber 128, the inlet means 130 are sealed and the second compression piston means 25 is then actuated by driving mechanism 143. Once the gas contained in the second compression chamber 128 has been compressed by the second compression piston means 129 up to approximately the level in the high pressure transfer means 73, the gas is transferred to the high pressure transfer means 73 by opening the high pressure exhaust means 127. The temperature of the gas entering the high pressure exhaust means 73 should be approximately ambient.

The gas is transferred by the high pressure transfer means 73 to the first ambient distribution chamber 58. The gas enters the first ambient distribution chamber 58 through the high pressure inlet means 56 and leaves immediately through the high pressure outlet 54'. The gas now passes through the high pressure transfer means 71' and is available to enter the first expander means 22' through the high pressure inlet means 27'.

The high pressure gas entering the first expander means 22' via the high pressure inlet means 27' is allowed to pass into the first expansion chamber 28'. Once the gas has entered the first expansion chamber 28', the high pressure inlet means 27' are sealed and the first expansion piston means 29' is then actuated by driving mechanism 43'. Once the gas contained in the first expansion chamber 28' has been expanded by the first expansion piston means 29' down to approximately the level in the low pressure transfer means 81', the gas is transferred to the low pressure transfer means 81' by opening the low pressure exhaust means 30'.

The gas is transferred by the low pressure transfer means 81' to the second heat storage means 60'. The gas enters the cold distribution chamber 67 through the low pressure inlet means 62' and leaves immediately through the low pressure outlet 65. The gas now passes through the low pressure transfer means 83 and is available to enter the second compressor means 122 through the low pressure inlet means 130.

If the power input equals the power output then there should be minimal flows through the first and second heat storage means 50' and 60' and there is, in effect, a direct fluid path between the first compressor means 21' and the second expander means 121 and also the first expander means 22' and the second compressor means 122. Any losses in this 'fluidic transmission' are likely to materialise as waste heat and it may be necessary to cool the high pressure transfer means 71' with a heat exchanger means 94 in order to maintain the base temperature at the correct level. This is in addition to that provided for on the low pressure transfer means 80' covered below.

If the gas is air and the low pressure is set at atmospheric pressure then it is likely that there will be a vent 90' or 91' located within the low pressure transfer means 80'. The vent 90' allows ambient air to enter and leave the system as necessary and prevents a rise in entropy of the system. If the gas is not air and/or the low pressure is not atmospheric pressure then the vent 91' will lead to a reservoir of the gas 92' that may be kept at a stable temperature by means of a heat exchanger 93'. If no heat exchanger is used and/or the gas is not vented to atmosphere then there will be a steady rise in the entropy (and hence temperature) of the system.

Mode (5)—Discharging Only

In this scenario the power is all being drawn from the first and second heat storage means 50' and 60'. It is identical to the situation of discharging for the device in FIG. 1. However, in this configuration the power is being output only and there is therefore no need to consider any flows through the first compressor means 21' and first expander means 22'. Assuming that there is sufficient stored energy to supply this power then it can be analysed as follows.

In use, a high pressure gas in the high pressure transfer means 72 enters the second expander means 121 via the high pressure inlet means 126 and is allowed to pass into the second expansion chamber 124. Once the gas has entered the second expansion chamber 124, the high pressure inlet means 126 are sealed and the second expansion piston means 125 is then actuated by driving mechanism 142. Once the gas contained in the second expansion chamber 124 has been expanded by the expansion piston means 125 down to approximately the level in the low pressure transfer means 82, the gas is transferred to the low pressure transfer means 82 by opening the high pressure exhaust means 123.

The gas is transferred by the low pressure transfer means 82 to the second heat storage means 60'. The gas enters the second ambient distribution chamber 68 through the high pressure inlet means 66 and passes through the second thermal store 63', which is enclosed within the second insulated pressure vessel 61'. As the gas passes through the second thermal store 63' it transfers thermal energy to the second thermal store 63' and leaves the cold distribution chamber 67 through the low pressure outlet means 65. The gas now passes through the low pressure transfer means 83 and enters the second compressor means 122 through the low pressure inlet means 130.

The low pressure gas entering the second compressor means 122 via the low pressure inlet means 130 is allowed to pass into the second compression chamber 128. Once the gas has entered the second compression chamber 128, the low pressure inlet means 130 are sealed and the second compression piston means 129 is then actuated by driving mechanism 143. Once the gas contained in the second compression chamber 128 has been compressed by the second compression piston means 129 up to approximately the level in the high pressure transfer means 73, the gas is transferred to the high pressure transfer means 73 by opening the high pressure exhaust means 127.

The gas is transferred by the high pressure transfer means 73 to the first heat storage means 50'. The gas enters the first ambient distribution chamber 58 through the high pressure inlet means 56 and passes through the first thermal store 53', which is enclosed within the first insulated pressure vessel 51'. As the gas passes through the first thermal store 53' it receives thermal energy from the first thermal store 53' and leaves the hot distribution means 57 through the high pressure outlet means 55. The gas now passes through the high pressure transfer means 72 and is available to enter the second expander means 121 through the high pressure inlet means 126.

If the gas is air and the low pressure is set at atmospheric pressure then it is likely that there will be a vent 90' or 91' located within the low pressure transfer means 80'. The vent 90' allows ambient air to enter and leave the system as necessary and prevents a rise in entropy of the system. If the gas is not air and/or the low pressure is not atmospheric pressure then the vent 91' will lead to a reservoir of the gas 92' that may be kept at a stable temperature by means of a heat exchanger 93'. If no heat exchanger is used and/or the gas is not vented to atmosphere then there will be a steady rise in the entropy (and hence temperature) of the system.

FIG. 5

FIG. 5 shows an energy storage system 210 comprising compressor means 221, first expander means 222, second expander means 223, third expander means 224, fourth expander means 225, power input/output means 241,242, 243,244,245, heat storage means 250, first heat exchanger means 200, second heat exchanger means 201, third heat exchanger means 202, fourth heat exchanger means 203, high pressure transfer means 270,271, intermediate pressure transfer means 272,273,274,275,276,277, and low pressure transfer means 278,280. In this diagram the compressor and multiple expander means 221,222,223,224,225 are shown as separate units with separate power input/output means 241, 242,243,244,245. In operation it may be desirable for all of these units to be mechanically linked and hence, operating from one common power input/output means.

The compressor means 221 operates in a similar manner to that described previously for compressor means. As in previous examples the compressor means 221 is configured to run in reverse and operate as an expander means in the discharging phase of the cycle. There are other alternative solutions to this, such as providing a separate expander for the discharge part of the cycle with suitable switching of the gas flow.

The first to fourth multiple expander means 222,223,224, 225 operate in a similar manner to that described previously for expander means, but drop the pressure over the four stages. The number of stages can vary, but the number is likely to depend upon mechanical losses and overall complexity. As in previous examples the expander means 222, 223,224,225 are configured to run in reverse and operate as compressor means in the discharging phase of the cycle. There are other alternative solutions to this such as providing separate compressors for the discharge part of the cycle with suitable switching of the flow.

The power input/output means 241,242,243,244,245 operates in a similar manner to that described previously for power input/output means. The energy source/demand is an energy source when used in power input mode or an energy demand when used in power output mode.

The heat storage means 250 operates in a similar manner to that described previously for heat storage means and includes an insulated pressure vessel 251 suitable for the high pressure and a thermal store 253.

The multiple heat exchangers (first to fourth) means 200, 201,202,203 are designed to return the flow to an ambient or base temperature as it passes through the heat exchanger. This applied regardless of which direction the flow is travelling in. The number of stages varies with the number of expander means.

The intermediate pressure transfer means are as follows: the pressure in 272 equals that in 273 (less any pressure difference caused by the heat exchanger) and is greater than 274,275,276,277; the pressure in 274 equals that in 275 (less any pressure difference caused by the heat exchanger) and is greater than 276,277; and the pressure in 276 equals that in 277 (less any pressure difference caused by the heat exchanger).

To charge the system, a low pressure gas in the low pressure transfer means 280 enters the compressor means 221 and is compressed up to approximately the level in the high pressure transfer means 270. This compression requires a power input from the power input/output means 241. The gas is transferred to the high pressure transfer means 270 and then passes in to the heat storage means 250. The gas passes through the thermal store 253, which is enclosed within the first insulated pressure vessel 251. As the gas passes through the thermal store 253 it transfers thermal energy to the thermal store 253 and then passes from the heat storage means 250 to the high pressure transfer means 271.

The gas enters the first expander means 222 and is partially expanded to the pressure in the intermediate pressure transfer means 272. This outputs power to the power/input output means 242. The gas then passes through the heat exchanger means 200 where it receives thermal energy and its temperature is raised to approximately ambient. The gas leaves the heat exchanger means 200 and enters the intermediate pressure transfer means 273.

The gas enters the second expander means 223 and is partially expanded to the pressure in the intermediate pressure transfer means 274. This outputs power to the power/input output means 243. The gas then passes through the heat exchanger means 201 where it receives thermal energy and its temperature is raised to approximately ambient. The gas leaves the heat exchanger means 201 and enters the intermediate pressure transfer means 275.

The gas enters the third expander means 224 and is partially expanded to the pressure in the intermediate pressure transfer means 276. This outputs power to the power/input output means 244. The gas then passes through the heat exchanger means 202 where it receives thermal energy and its temperature is raised to approximately ambient. The gas leaves the heat exchanger means 202 and enters the intermediate pressure transfer means 277.

The gas enters the fourth expander means 224 and is partially expanded to the pressure in the low pressure transfer means 278. This outputs power to the power/input output means 245. The gas then passes through the heat exchanger means 203 where it receives thermal energy and its temperature is raised to approximately ambient. The gas leaves the heat exchanger means 203 and enters the low pressure transfer means 280.

This process can be run until the heat storage means 250 is fully charged (thermal store 253 is all hot), after which no more energy can be stored in the system. To discharge the process is reversed and the compressor means 221 operates as an expander and the multiple expander means 222,223,224, 225 operate as compressors. The flows through the system are reversed and once the system has discharged, the temperatures throughout the system will be approximately returned to that at which they started.

If the gas is air and the low pressure is set at atmospheric pressure then it is likely that there will be a vent 290 or 291 located within the low pressure transfer means 280. The vent 290 allows ambient air to enter and leave the system as necessary and prevents a rise in entropy of the system. If the gas is not air and/or the low pressure is not atmospheric pressure then the vent 291 will lead to a reservoir of the gas 292 that may be kept at a stable temperature by means of a heat exchanger 293. If no heat exchanger is used and/or the gas is not vented to atmosphere then there will be a steady rise in the entropy (and hence temperature) of the system.

Figure 7:
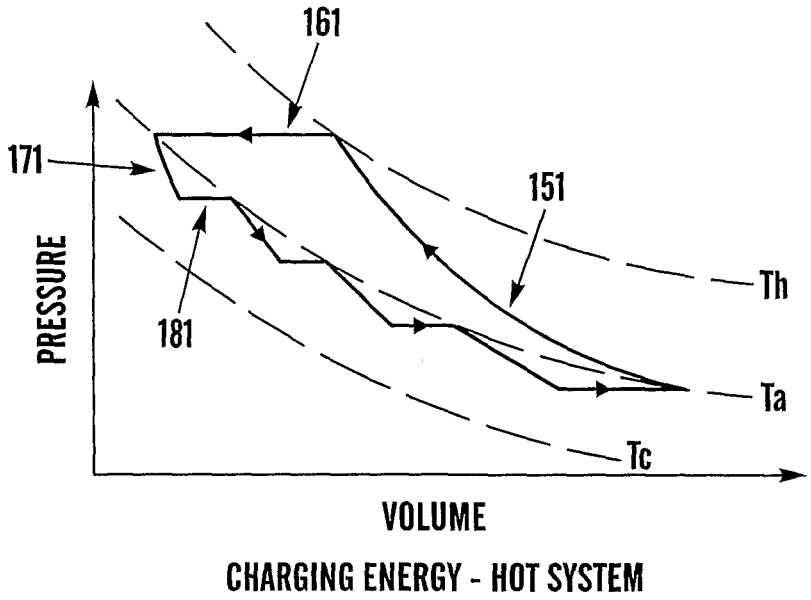
FIG. 7 shows a P-V diagram modelling a typical cycle of the apparatus of FIG. 5 during charging.

FIG. 7—Charging System in FIG. 5

FIG. 7 shows an idealised P-V (pressure plotted against volume) diagram for energy store 210 in the charging phase. Curve 151 at the right-hand side of the diagram represents an isentropic compression of the gas flow in the compressor means 221 from, in this example, ambient temperature and pressure; the straight portion 161 represents isobaric cooling of the flow as it passes through the heat storage means 250; curves 171 at the left-hand side of the diagram represent a series of isentropic expansions back to atmospheric pressure in the expander means 222,223,224,225; and the straight portions 181 represents isobaric heating of the flow as it passes through a series of heat exchanger means 200,201,202,203 back to ambient temperature. The higher the number of expander means (four in this example) and heat exchanger means (four in this example) the more the expansion will be substantially isothermal. The work done in charging is equal to the area inside the lines. Of course, the real P-V diagram is likely to exhibit some further differences from the idealized cycle due to irreversible processes occurring within the real cycle.

Figure 8:
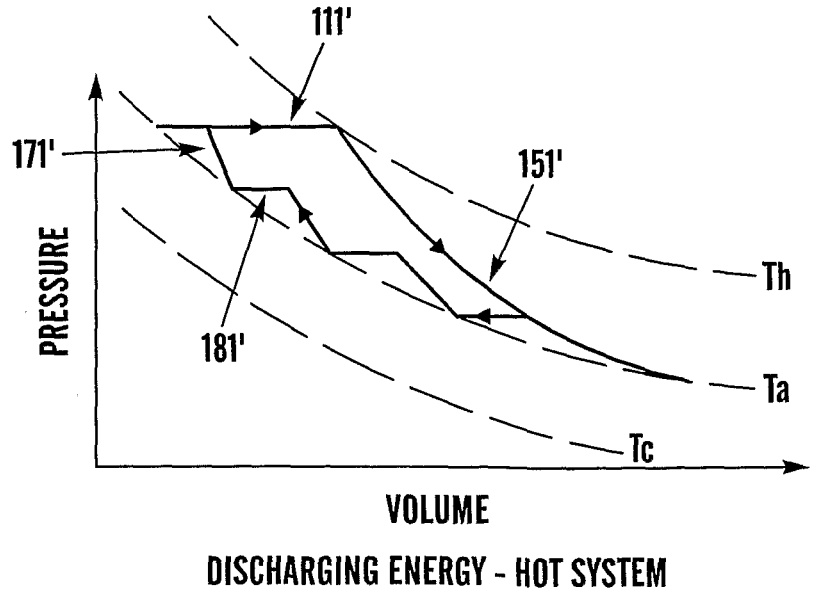
FIG. 8 shows a P-V diagram modelling a typical cycle of the apparatus of FIG. 5 during discharging.

FIG. 8—Discharging System in FIG. 5

FIG. 8 shows an idealised P-V (pressure plotted against volume) diagram for energy store 250 in the discharging phase. Curves 171' at the left-hand side of the diagram represent a series of isentropic compressions, starting from atmospheric pressure, in the expander means 222,223,224,225; the straight portions 181' represents isobaric cooling of the flow as it passes through a series of heat exchanger means 200,201,202,203 back to ambient temperature; the straight portion 161' represents isobaric heating of the flow as it passes through the heat storage means 250; and curve 151' at the right-hand side of the diagram represents an isentropic expansion of the gas flow in the compressor means 221 to, in this example, ambient temperature and pressure. The higher the number of expander means (four in this example) and heat exchanger means (four in this example) the more the compression will be substantially isothermal. The work done in discharging is equal to the area inside the lines, which will be less than that used to charge the system, unless the expansions and compressions are very close to isothermal. Of course, the real P-V diagram is likely to exhibit some further differences from the idealized cycle due to irreversible processes occurring within the real cycle.

Figure 11:
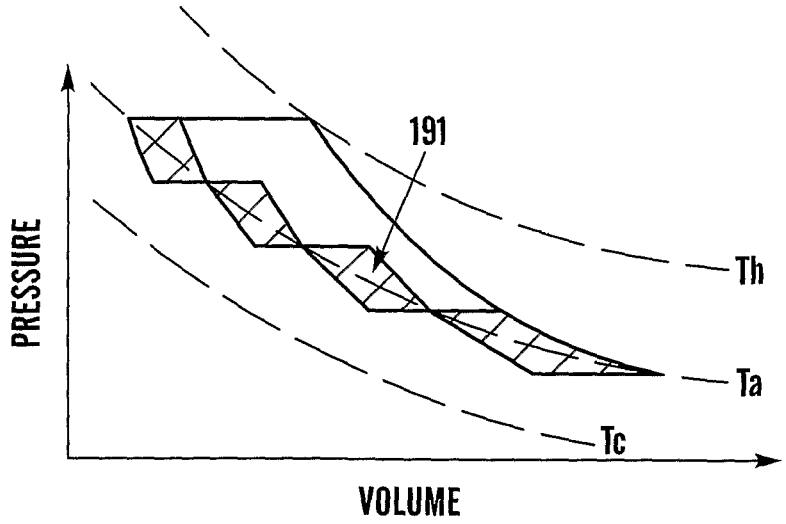
FIG. 11 shows a P-V diagram illustrating energy loss in the apparatus of FIG. 5.

FIG. 11 P-V Diagram Illustrating Energy Loss in the Apparatus of FIG. 5

The difference in work done in storing energy to that recovered by the system is equal to the shaded area 191. This shows that unless there are other relevant factors the combined system shown in FIGS. 1 and 2 will always be more efficient.

FIG. 6

FIG. 6 shows an energy storage system 310 comprising first compressor means 321, second compressor means 322, third compressor means 323, fourth compressor means 324, expander means 325, power input/output means 341,342,343,344,345, heat storage means 350, first heat exchanger means 300, second heat exchanger means 301, third heat exchanger means 302, fourth heat exchanger means 303, high pressure transfer means 378,379, intermediate pressure transfer means 372,373,374,375,376,377, and low pressure transfer means 371,380. In this diagram the compressor and multiple expander means 321,322,323,324,325 are shown as separate units with separate power input/output means 341,342,343,344,345. In operation it may be desirable for all of these units to be mechanically linked and hence, operating from one common power input/output means.

The multiple compressor means 321,322,323,324 operate in a similar manner to that described previously for compressor means, but raise the pressure over the four stages. The number of stages can vary, but the number is likely to depend upon mechanical losses and overall complexity. As in previous examples, the compressor means 321,322,323,324 are configured to run in reverse and operate as an expander means in the discharging phase of the cycle. There are other alternative solutions to this, such as providing a separate expander for the discharge part of the cycle with suitable switching of the gas flow.

The expander means 325 operates in a similar manner to that described previously for expander means. As in previous examples, the expander means 325 is configured to run in reverse and operate as compressor means in the discharging phase of the cycle. There are other alternative solutions to this such as providing separate compressors for the discharge part of the cycle with suitable switching of the flow.

The power input/output means 341,342,343,344,345 operate in a similar manner to that described previously for power input/output means. The energy source/demand is an energy source when used in power input mode or an energy demand when used in power output mode.

The heat storage means 350 operates in a similar manner to that described previously for heat storage means and includes an insulated pressure vessel 351 suitable for the low pressure and a thermal store 353.

The first to fourth multiple heat exchangers means 300,301,302,303 are designed to return the flow to an ambient or base temperature as it passes through the heat exchanger. This applied regardless of which direction the flow is travelling in. The number of stages varies with the number of expander means.

The intermediate pressure transfer means are as follows: the pressure in 372 equals that in 373 (less any pressure difference caused by the heat exchanger) and is less than 374,375,376,377; the pressure in 374 equals that in 375 (less any pressure difference caused by the heat exchanger) and is less than 376,377; and the pressure in 376 equals that in 377 (less any pressure difference caused by the heat exchanger).

To charge the system, a low pressure gas in the low pressure transfer means 371 enters the first compressor means 321 and is partially compressed to the pressure in the intermediate pressure transfer means 372. This requires an input of power from the power/input output means 341. The gas then passes through the heat exchanger means 300 where it loses thermal energy and its temperature is lowered to approximately ambient. The gas leaves the heat exchanger means 300 and enters the intermediate pressure transfer means 373.

The gas enters the second compressor means 322 and is partially compressed to the pressure in the intermediate pressure transfer means 374. This requires an input of power from the power/input output means 342. The gas then passes through the heat exchanger means 301 where it loses thermal energy and its temperature is lowered to approximately ambient. The gas leaves the heat exchanger means 301 and enters the intermediate pressure transfer means 375.

The gas enters the third compressor means 323 and is partially compressed to the pressure in the intermediate pressure transfer means 376. This requires an input of power from the power/input output means 343. The gas then passes through the heat exchanger means 302 where it loses thermal energy and its temperature is lowered to approximately ambient. The gas leaves the heat exchanger means 302 and enters the intermediate pressure transfer means 377.

The gas enters the fourth compressor means 324 and is partially compressed to the pressure in the high pressure transfer means 378. This requires an input of power from the power/input output means 344. The gas then passes through the heat exchanger means 303 where it loses thermal energy and its temperature is lowered to approximately ambient. The gas leaves the heat exchanger means 303 and enters the high pressure transfer means 379.

The gas enters the expander means 325 and is expanded down to approximately the level in the low pressure transfer means 380. This expansion outputs power to the power input/output means 345. The gas is transferred to the low pressure transfer means 380 and then passes in to the heat storage means 350. The gas passes through the thermal store 353, which is enclosed within the first insulated pressure vessel 351. As the gas passes through the thermal store 353 it receives thermal energy from the thermal store 353 and then passes from the heat storage means 350 to the low pressure transfer means 371.

This process can be run until the heat storage means 350 is fully charged (thermal store 353 is all cold), after which no more energy can be stored in the system. To discharge the process is reversed and the expander means 325 operates as a compressor and the multiple compressor means 321,322,323,324 operate as expanders. The flows through the system are reversed and once the system has discharged, the temperatures throughout the system will be approximately returned to that at which they started.

If the gas is air and the low pressure is set at atmospheric pressure then it is likely that there will be a vent 390 or 391 located within the low pressure transfer means 380. The vent 390 allows ambient air to enter and leave the system as necessary and prevents a rise in entropy of the system. If the gas is not air and/or the low pressure is not atmospheric pressure then the vent 391 will lead to a reservoir of the gas 392 that may be kept at a stable temperature by means of a heat exchanger 393. If no heat exchanger is used and/or the gas is not vented to atmosphere then there will be a steady rise in the entropy (and hence temperature) of the system.

Figure 9:
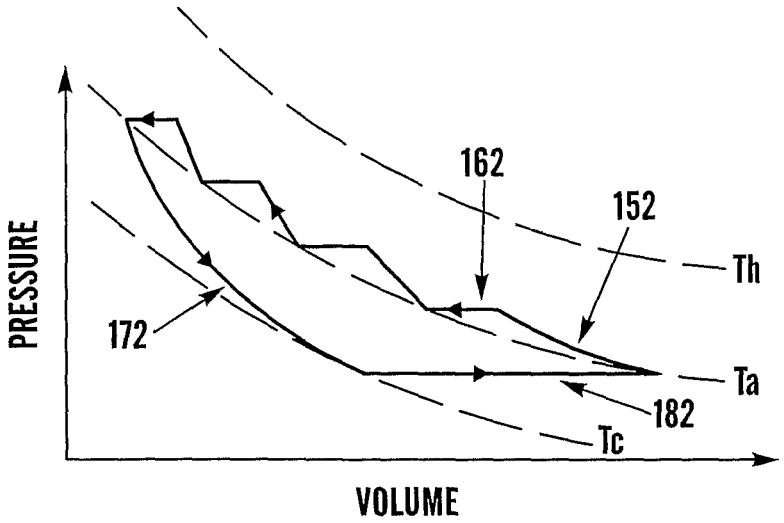
FIG. 9 shows a P-V diagram modelling a typical cycle of the apparatus of FIG. 6 during charging.

FIG. 9—Charging System in FIG. 6

FIG. 9 shows an idealised P-V (pressure plotted against volume) diagram for energy store 310 in the charging phase. Curves 152 at the right-hand side of the diagram represents a series of isentropic compressions of the gas flow in the compressor means 321,322,323,324 from, in this example, ambient temperature and pressure; the straight portions 162 represents isobaric cooling of the flow as it passes through the heat exchanger means 300,301,302,303; curve 172 at the left-hand side of the diagram represent an isentropic expansion back to atmospheric pressure in the expander means 325; and the straight portion 182 represents isobaric heating of the flow as it passes through the heat storage means 350 back to ambient temperature. The higher the number of compressor means (four in this example) and heat exchangers means (four in this example) the more the compression will be substantially isothermal. The work done in charging is equal to the area inside the lines. Of course, the real P-V diagram is likely to exhibit some further differences from the idealized cycle due to irreversible processes occurring within the real cycle.

Figure 10:
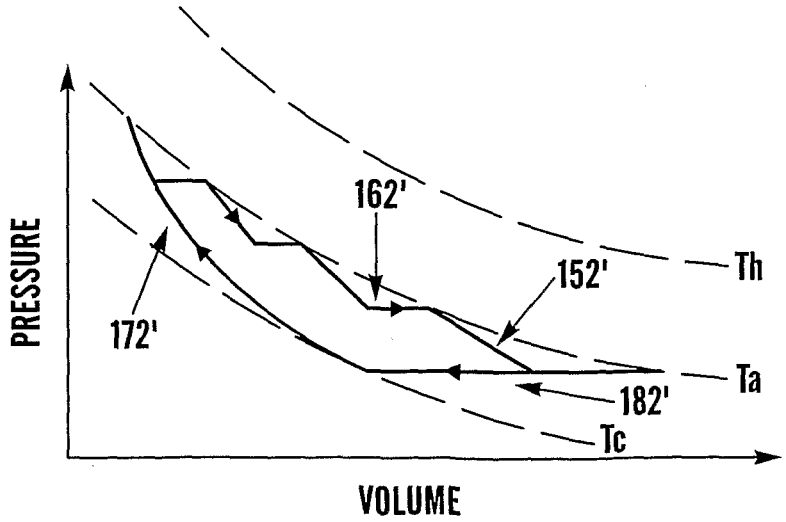
FIG. 10 shows a P-V diagram modelling a typical cycle of the apparatus of FIG. 6 during discharging.

FIG. 10—Discharging System in FIG. 6

FIG. 10 shows an idealised P-V (pressure plotted against volume) diagram for energy store 310 in the discharging phase. The straight portion 182' represents isobaric cooling of the flow from ambient temperature as it passes through the heat storage means 360; curve 172 at the left-hand side of the diagram represent an isentropic compression in the expansion piston means 325; curves 152 at the right-hand side of the diagram represents a series of isentropic expansions of the gas flow in the compressor means 321,322,323,324 to, in this example, ambient temperature and pressure; and the straight portions 162 represents isobaric heating of the flow as it passes through the heat exchanger means 300,301,302,303. The higher the number of compressor means (four in this example) and heat exchangers means (four in this example) the more the expansion will be substantially isothermal. The work done in discharging is equal to the area inside the lines, which will be less than that used to charge the system, unless the expansions and compressions are very close to isothermal. Of course, the real P-V diagram is likely to exhibit some further differences from the idealized cycle due to irreversible processes occurring within the real cycle.

Figure 12:
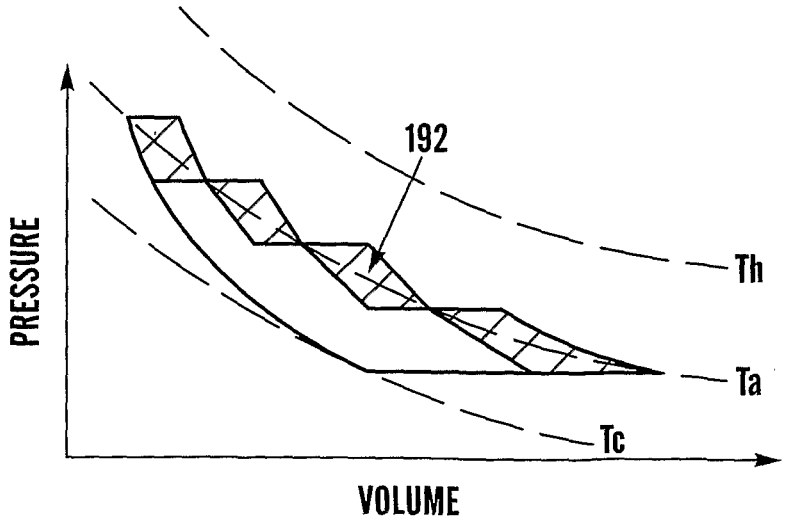
FIG. 12 shows a P-V diagram illustrating energy loss in the apparatus of FIG. 6.

FIG. 12—P-V Diagram Illustrating Energy Loss in the Apparatus of FIG. 6

The difference in work done in storing energy to that recovered by the system is equal to the shaded area 192. This shows that unless near isothermal compression or expansion is achieved or there are other relevant factors the combined system shown in FIGS. 1 and 2 will always be the most efficient system.

Figure 13:
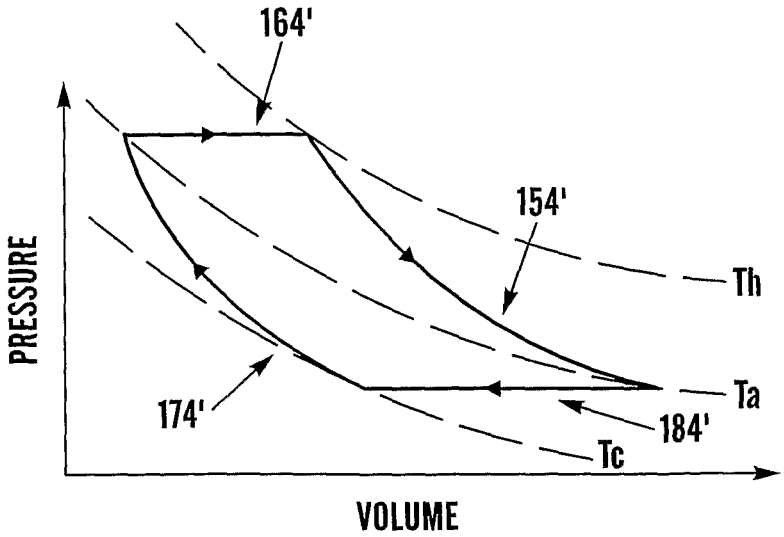
FIG. 13 shows a P-V diagram modelling a typical cycle of the apparatus of FIG. 6 when heat is added.

FIG. 13—Charging/Discharging System in FIG. 6 when Heat is Added in the Discharge Stage FIG. 13 shows an idealised P-V (pressure plotted against volume) diagram for energy store 310 where heat is added in the discharge phase.

The description of how this system is charged is covered in FIG. 9.

The variation in this situation is the discharge procedure. The straight portion 184' represents isobaric cooling of the gas flow from, in this example, ambient temperature and pressure as it passes through the second heat storage means 360; curve 174' at the left-hand side of the diagram represents an isentropic compression in the expander means 325; the straight portion 164' represents isobaric heating of the flow as it receives added heat to ambient plus; and curve 154' at the right-hand side of the diagram represents an isentropic expansion of the gas in an expander means (not previously shown, but similar to expander means 325) back to atmospheric pressure. Of course, the real P-V diagram is likely to exhibit some differences from the idealized cycle due to irreversible processes occurring within the real cycle.

Figure 14:
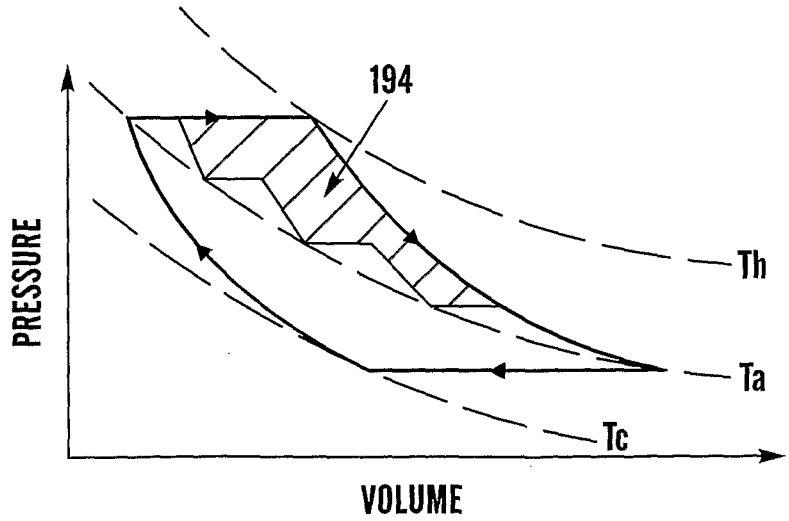
FIG. 14 shows a P-V diagram illustrating the additional energy gains resulting from added heat.

FIG. 14—P-V Diagram Illustrating the Additional Energy Gains Resulting from Added Heat FIG. 14 shows the recoverable work as the shaded area 194 and from this it can be seen that if the upper and lower temperatures are selected carefully then it is possible to increase the level of energy recovered such that it is greater than that required to charge the system.

Figure 15:
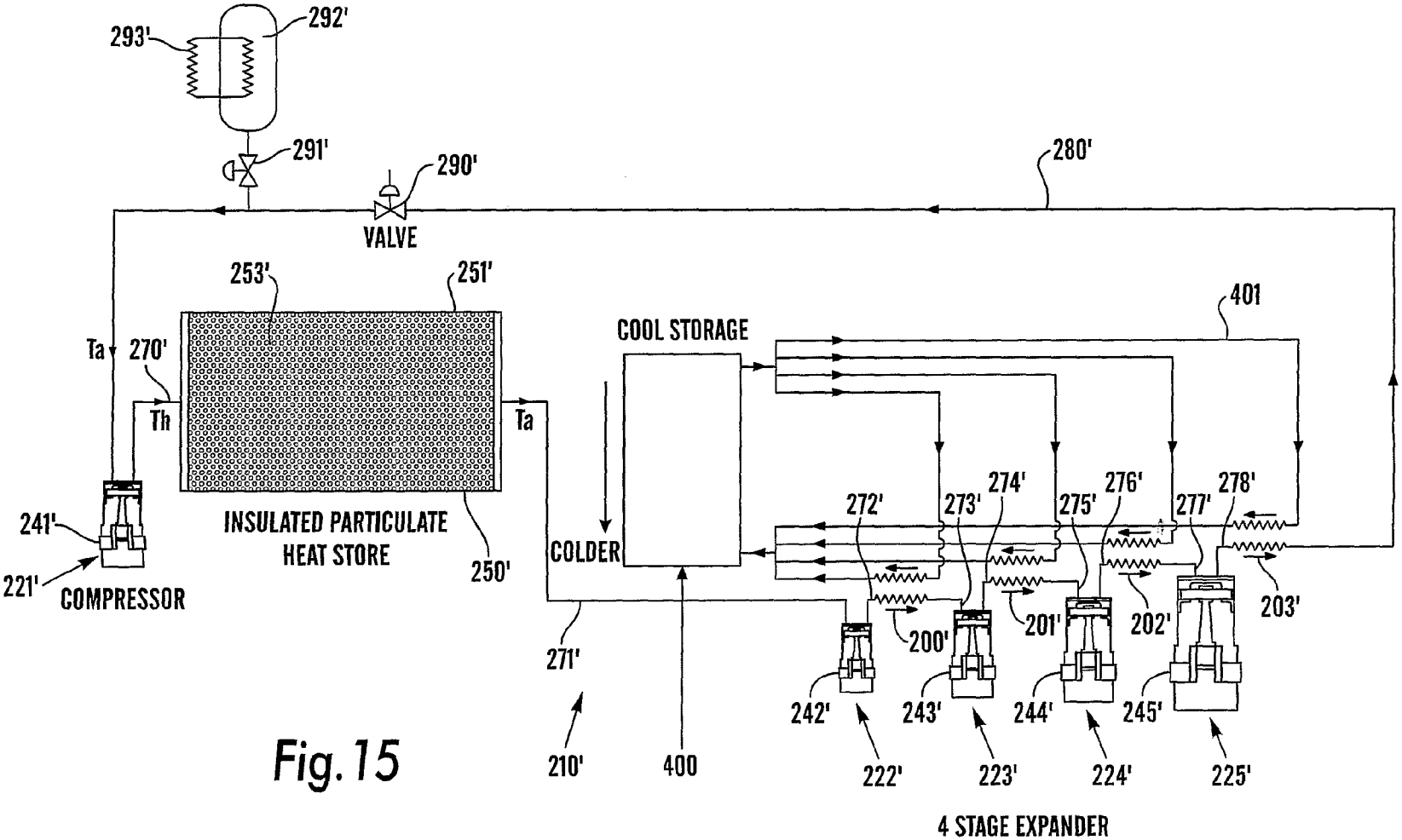
FIG. 15 is a schematic illustration of a second embodiment of energy storage apparatus according to the third aspect of the present invention.

FIG. 15—Hybrid Hot System

FIG. 15 shows an energy storage system 210' based on energy storage system 210 previously described with reference to FIG. 5. Energy storage system 210' comprises compressor means 221', first expander means 222', second expander means 223', third expander means 224', fourth expander means 225', power input/output means 241',242',243',244',245', heat storage means 250', first heat exchanger means 200', second heat exchanger means 201', third heat exchanger means 202', fourth heat exchanger means 203', high pressure transfer means 270',271', intermediate pressure transfer means 272',273',274',275',276',277', and low pressure transfer means 278',280'. However, in contrast to system 210, heat exchanger means 200',201',202',203' are not exposed to atmosphere but instead are thermally coupled to cold storage means 400 via a counter-flow heat exchanger 401.

If the expansion ratio is kept the same for each expander means 222',223',224',225', only a single cold store is required (as shown) since each of the minimum temperatures will be the same. In this configuration, the cold storage means 400 is assumed to be configured such that a temperature gradient can exist in the store, with the hottest material at the top of the store. The cold storage means 400 may be a cold water store.

Figure 17:
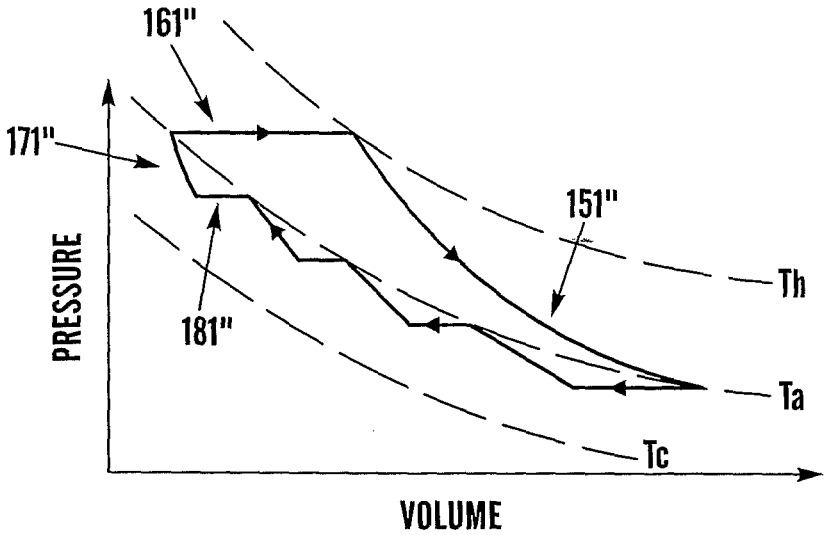
FIG. 17 shows a P-V diagram modelling a typical cycle of the apparatus of FIG. 15 during discharging.

FIG. 17—Discharging Hybrid Hot System in FIG. 15

FIG. 7 shows an idealised P-V (pressure plotted against volume) diagram for energy store 210 in the charging phase. FIG. 7 is also the same for charging the Hybrid Hot System 210' illustrated in FIG. 15, but the straight portions 181 represent isobaric heating of the flow as it receives heat from cold storage means 400 through the series of heat exchanger means 200',201',202',203'. The temperature that the gas is raised to depends upon the cold storage means 400 temperature and the size of the heat exchangers 200',201',202',203'. The higher the expansion ratio, the lower the temperature of the cold storage means 400.

FIG. 17 shows an idealised P-V (pressure plotted against volume) diagram for hybrid system 210' in the discharging phase. Curves 171" at the left-hand side of the diagram represent a series of isentropic compressions, starting from atmospheric pressure, in the expander means 222',223',224',225'; the straight portions 181" represent isobaric cooling of the flow as it passes through a series of heat exchanger means 200',201',202',203' connected to the cold store means 400; the straight portion 161" represents isobaric heating of the flow as it passes through the heat storage means 250'; and curve 151" at the right-hand side of the diagram represents an isentropic expansion of the gas flow in the compressor means 221' to, in this example, ambient temperature and pressure. The real P-V diagram is likely to exhibit some further differences from the idealized cycle due to irreversible processes occurring within the real cycle.

Figure 16:
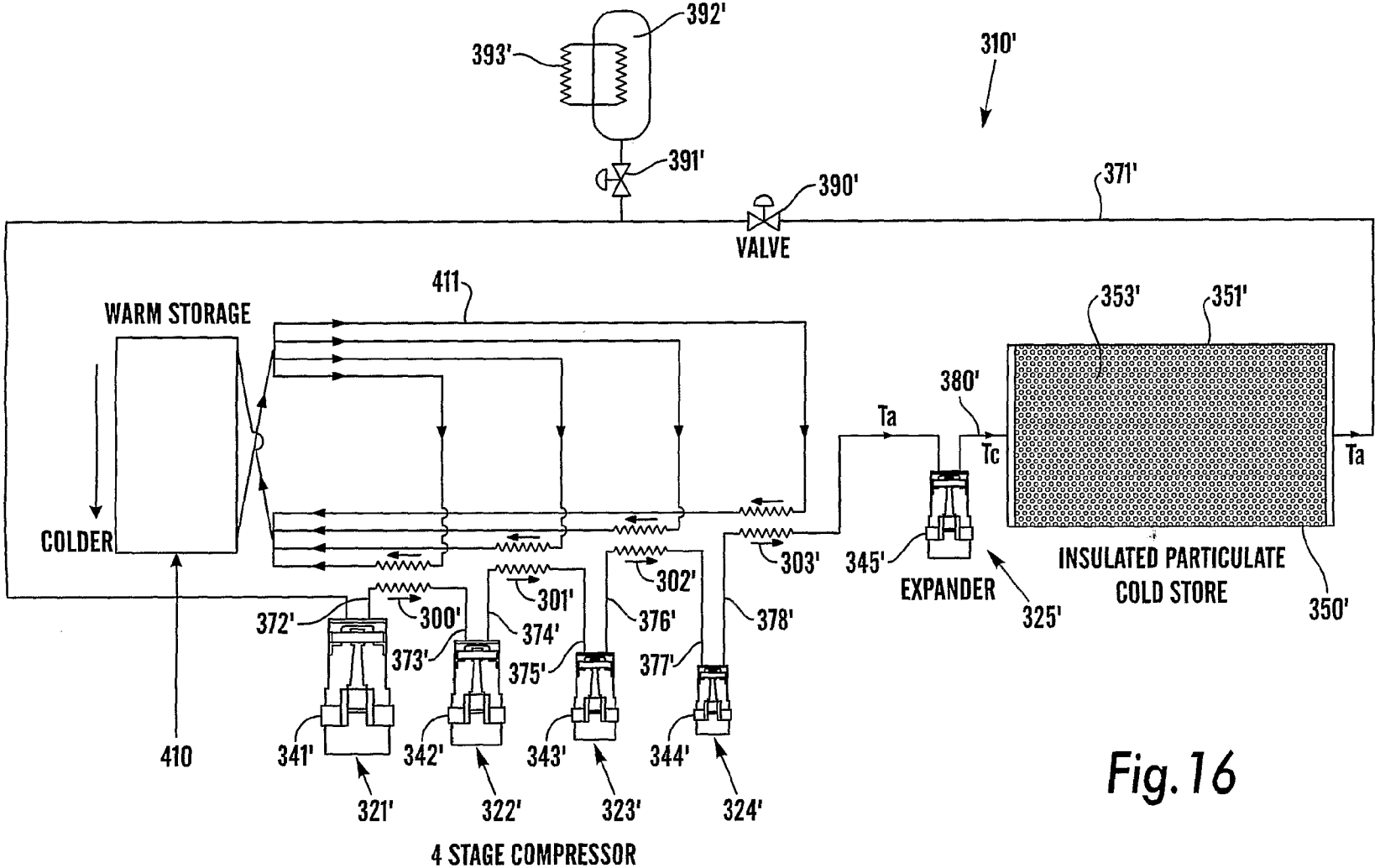
FIG. 16 is a schematic illustration of a second embodiment of energy storage apparatus according to the fourth aspect of the present invention.

FIG. 16—Hybrid Cold System

FIG. 16 shows an energy storage system 310' based on energy storage system 310 previously described with reference to FIG. 6. Energy storage system 310' comprises first compressor means 321', second compressor means 322', third compressor means 323', fourth compressor means 324', expander means 325', power input/output means 341',342',343',344',345', heat storage means 350', first heat exchanger means 300', second heat exchanger means 301', third heat exchanger means 302', fourth heat exchanger means 303', high pressure transfer means 378',379', intermediate pressure transfer means 372',373',374',375',376',377', and low pressure transfer means 371',380'. However, in contrast to system 310, heat exchanger means 300',301',302',303' are not exposed to atmosphere but instead are thermally coupled to warm storage means 410 via a counter-flow heat exchanger 411.

If the expansion ratio is kept the same for each compressor means 322',323',324',325', only a single warm store is required (as shown) since each of the peak temperatures will be the same. In this configuration, the warm storage means 410 is assumed to be configured such that a temperature gradient can exist in the store, with the hottest material at the top of the store. The warm storage means 410 may be a warm water store.

Figure 18:
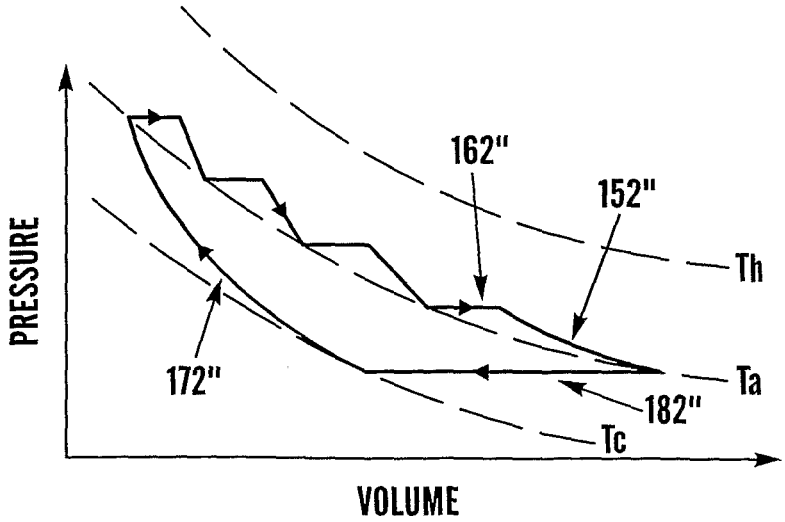
FIG. 18 shows a P-V diagram modelling a typical cycle of the apparatus of FIG. 16 during discharging.

FIG. 18—Discharging Hybrid Cold System in FIG. 16.

FIG. 9 shows an idealised P-V (pressure plotted against volume) diagram for energy store 310 in the charging phase. FIG. 9 is also the same for charging the Hybrid Cold System, but the straight portions 162 represent isobaric cooling of the flow as it transfers heat to warm storage means 410 through a series of heat exchanger means 300',301',302',303'. The temperature that the gas is cooled to depends upon the warm storage means temperature and the size of the heat exchanger means 300',301',302',303'. The higher the compression ratio the higher the temperature of the warm storage means 410.

FIG. 18 shows an idealised P-V (pressure plotted against volume) diagram for hybrid system 310' in the discharging phase. The straight portion 182" represents isobaric cooling of the flow from ambient temperature as it passes through the heat storage means 350'; curve 172" at the left-hand side of the diagram represent an isentropic compression in the expansion piston means 325'; curves 152" at the right-hand side of the diagram represents a series of isentropic expansions of the gas flow in the compressor means 321',322',323',324' and the straight portions 162" represents isobaric heating of the flow as it passes through the heat exchanger means 300',301',302',303' connected to the warm storage means 410. The real P-V diagram is likely to exhibit some further differences from the idealized cycle due to irreversible processes occurring within the real cycle.

The invention claimed is:

1. Energy storage apparatus comprising:

a compression chamber configured to receive a gas;

a compression piston configured to compress the gas contained in the compression chamber;

a first thermal store configured to receive and store thermal energy from the gas compressed by the compression piston;

an expansion chamber configured to receive the gas after exposure to the first thermal store;

an expansion piston configured to expand the gas received in the expansion chamber; and a second thermal store configured to transfer thermal energy to the gas expanded by the expansion piston;

wherein expansion by the expansion piston or compression by the compression piston is substantially isentropic or substantially adiabatic, wherein a flow path of the gas passes through each of the first and second thermal stores for storing thermal energy from the gas and for transfer of thermal energy to the gas, respectively, and wherein the first and second thermal stores are configured to charge in a charging mode of the energy storage apparatus so as to store energy in the energy storage apparatus.

2. Energy storage apparatus according to claim 1, wherein at least one of the first and second thermal stores comprises a chamber for receiving the gas, and particulate material housed in the chamber.

3. Energy storage apparatus according to claim 2, wherein the particulate material comprises solid particles and/or fibres packed to form a gas-permeable structure.

4. Energy storage apparatus according to claim 3, wherein the solid particles comprise a mineral or ceramic.

5. Energy storage apparatus according to claim 1, wherein one or both of the compression piston and the expansion piston is configurable to operate in reverse during discharge.

6. A system for transmitting mechanical power from an input device to an output device, the system comprising the energy storage apparatus according to claim 1 and a heat engine section, the heat engine section comprising:

a second compression chamber in fluid communication with the second thermal store and the first thermal store;

a second compression piston for compressing the gas received in the second compression chamber for transfer to the first thermal store;

a second expansion chamber in fluid communication with the first thermal store and the second thermal store; and a second expansion piston for allowing expansion of the gas received in the second expansion chamber from the first thermal store.

7. A system according to claim 6, wherein energy is stored in a first mode of operation when the power output from the system is less than the power supplied and energy is automatically recovered in a second mode of operation when the power required from the system increases above that of the power supplied.

8. A system according to claim 7, wherein the change between the first and second modes of operation is configured to occur automatically.

9. A system according to claim 8, wherein the system is configured to react automatically to an imbalance in input and output powers.

10. A system according to claim 8, wherein the system is configured to automatically bypass the first and second thermal stores when the power supplied and used are balanced.

11. Energy storage apparatus according to claim 1, wherein the energy storage apparatus has a base system pressure above atmospheric pressure.

12. Energy storage apparatus according to claim 1, further comprising a generator for recovering energy stored in the first and second thermal stores.

13. Energy storage apparatus according to claim 1, wherein the transfer of the thermal energy is substantially isobaric.

14. Energy storage apparatus according to claim 1, wherein the energy storage apparatus is operable in a discharging mode for recovering energy in which the first and second thermal stores are discharged.

15. Energy storage apparatus according to claim 1, wherein the charging mode comprises a substantially isentropic compression stage, a substantially isobaric cooling stage, a substantially isentropic expansion stage, and a substantially isobaric heating stage.

16. Energy storage apparatus according to claim 1, wherein the flow path of the gas forms a closed gas cycle in which the gas re-enters the compression chamber after passing through the second thermal store.

17. Energy storage apparatus according to claim 1, wherein the energy storage apparatus has a base system pressure below atmospheric pressure.

18. Energy storage apparatus according to claim 1, wherein the compression piston and the expansion piston are operable for expansion and compression, respectively, in a discharge mode in which the flow path of the gas is reversed to recover energy from the energy storage apparatus.

19. A method of storing energy in an energy storage apparatus, the method comprising:

receiving a gas in a compression chamber of the energy storage apparatus;

substantially isentropically or substantially adiabatically compressing the received gas in the compression chamber;

storing thermal energy from the compressed gas in a first thermal store of the energy storage apparatus;

receiving the gas in an expansion chamber of the energy storage apparatus after exposure to the first thermal store;

substantially isentropically or substantially adiabatically expanding the received gas in the expansion chamber; and transferring thermal energy to the expanded gas in a second thermal store of the energy storage apparatus;

wherein a flow path of the gas passes through each of the first and second thermal stores for storing thermal energy from the gas and for transfer of thermal energy to the gas, respectively.

20. A method of storing energy in an energy storage apparatus, the method comprising:

charging first and second thermal stores of the energy storage apparatus in a charging mode of the energy storage apparatus to store energy in the energy storage apparatus, wherein charging the first and second thermal stores comprises:

receiving a gas in a compression chamber of the energy storage apparatus;

substantially isentropically or substantially adiabatically compressing the received gas in the compression chamber;

storing thermal energy from the compressed gas in the first thermal store of the energy storage apparatus;

receiving the gas in an expansion chamber of the energy storage apparatus after exposure to the first thermal store;

substantially isentropically or substantially adiabatically expanding the received gas in the expansion chamber; and transferring thermal energy to the expanded gas in the second thermal store of the energy storage apparatus;

wherein a flow path of the gas passes through each of the first and second thermal stores for storing thermal energy from the gas and for transfer of thermal energy to the gas, respectively, and wherein the first and second thermal stores are separate from the compression chamber and the expansion chamber, respectively.

* * * * *